US011537071B2

(12) United States Patent
Kitago

(10) Patent No.: US 11,537,071 B2
(45) Date of Patent: Dec. 27, 2022

(54) IMAGE FORMING APPARATUS CAPABLE OF PREVENTING AN IMAGE DEFECT CAUSED BY A VARIATION IN THE SHAPE OF A BELT UPSTREAM OF A TRANSFER PORTION

(71) Applicant: CANON KABUSHIKI KAISHA, Tokyo (JP)

(72) Inventor: Shinya Kitago, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/546,996

(22) Filed: Dec. 9, 2021

(65) Prior Publication Data

US 2022/0197201 A1 Jun. 23, 2022

(30) Foreign Application Priority Data

Dec. 18, 2020 (JP) ..... JP2020-210845

(51) Int. Cl.
*G03G 15/16* (2006.01)
*G03G 15/20* (2006.01)

(52) U.S. Cl.
CPC ..... *G03G 15/2053* (2013.01); *G03G 15/161* (2013.01); *G03G 15/1615* (2013.01)

(58) Field of Classification Search
CPC ..... G03G 15/1605; G03G 15/161; G03G 15/1615; G03G 15/1625; G03G 15/165
USPC ..... 399/302, 308, 316, 317
See application file for complete search history.

(56) References Cited

U.S. PATENT DOCUMENTS

| | | | | |
|---|---|---|---|---|
| 9,229,374 | B2 * | 1/2016 | Kakehi | G03G 15/1615 |
| 9,348,266 | B2 * | 5/2016 | Kakehi | G03G 15/1605 |
| 9,804,535 | B2 * | 10/2017 | Kakehi | G03G 15/161 |
| 9,904,214 | B2 * | 2/2018 | Kakehi | G03G 15/1605 |
| 11,347,165 | B2 * | 5/2022 | Kakehi et al. | G03G 15/161 |
| 2021/0397112 | A1 * | 12/2021 | Tsuruga et al. | G03G 15/1615 |

FOREIGN PATENT DOCUMENTS

JP H0980926 A 3/1997

* cited by examiner

*Primary Examiner* — William J Royer
(74) *Attorney, Agent, or Firm* — Canon U.S.A., Inc. I.P. Division

(57) ABSTRACT

An image forming apparatus includes a belt, tension rollers, an outer member, a pressing member, a moving mechanism, and an attachable unit. The belt bears a toner image and the tension rollers stretch the belt around rollers. The toner image is transferred at the outer member from the belt onto a recording material. The moving mechanism moves the pressing member to press an inner surface of the belt toward an outer surface side. The attachable unit includes the pressing member or the belt and attaches to and detaches from the image forming apparatus. A mode is executed in which the pressing member presses the belt to transfer the toner image onto the recording material. Information is stored based on an individual difference of the attachable unit related to a setting of a moving mechanism position in executing the mode, where the setting is based on the stored information.

19 Claims, 14 Drawing Sheets

IMAGE FORMING APPARATUS CAPABLE OF PREVENTING AN IMAGE DEFECT CAUSED BY A VARIATION IN THE SHAPE OF A BELT UPSTREAM OF A TRANSFER PORTION

BACKGROUND

Field

The present disclosure relates to an image forming apparatus that uses an electrophotographic method or an electrostatic recording method, such as a printer, a printing machine, a copying machine, a facsimile apparatus, and a multifunction peripheral including a plurality of functions thereof.

Description of the Related Art

Some of image forming apparatuses that use the electrophotographic method include a rotatable endless belt (hereinafter, will be simply referred to as a "belt") serving as an image bearing member that conveys a toner image while bearing the toner image. As such a belt, for example, there is an intermediate transfer belt serving as a second image bearing member that conveys a toner image primarily transferred from a photosensitive member serving as a first image bearing member, for secondarily transferring the toner image onto a sheet-like recording material such as paper. Hereinafter, an image forming apparatus employing an intermediate transfer system including an intermediate transfer belt will be mainly described as an example.

In an image forming apparatus that uses an intermediate transfer belt, a toner image formed on a photosensitive member at an image forming portion is primarily transferred onto the intermediate transfer belt at a primary transfer portion. The toner image primarily transferred onto the intermediate transfer belt is secondarily transferred onto a recording material at a secondary transfer portion. By an inner member (secondary transfer inner member) provided on the inner circumferential side of the intermediate transfer belt, and an outer member (secondary transfer outer member) provided on the outer circumferential side of the intermediate transfer belt, the secondary transfer portion that is a contact portion between the intermediate transfer belt and the outer member is formed. A secondary transfer inner roller, which is one of a plurality of tension rollers that stretches the intermediate transfer belt, is used as the inner member. A secondary transfer outer roller that is arranged at a position facing the secondary transfer inner roller via the intermediate transfer belt, and pressed toward the secondary transfer inner roller is often used as the outer member. Then, by a voltage with the reverse polarity to the charging polarity of toner being applied to the secondary transfer outer roller (or by a voltage with the same polarity as the charging polarity of toner being applied to the secondary transfer inner roller), the toner image on the intermediate transfer belt is secondarily transferred onto a recording material at the secondary transfer portion. The "leading end" and the "trailing end" of the recording material respectively refer to the leading end and the trailing end in a conveyance direction of the recording material. An upstream of the secondary transfer portion in a rotational direction of the intermediate transfer belt will also be simply referred to as an "upstream of the secondary transfer portion".

For accurately transferring a toner image formed on the intermediate transfer belt, onto a recording material, a contact length between the intermediate transfer belt and the recording material in the rotational direction of the intermediate transfer belt at the upstream of the secondary transfer portion is important. In a case where the contact length is long, an image defect might occur due to sliding friction between toner and the recording material caused by a speed difference between the intermediate transfer belt and the recording material. On the other hand, in a case where the contact length is short, an image defect might occur due to electric discharge occurring in an airspace between the recording material and the intermediate transfer belt. Thus, the conveyance orientation of the recording material and the stretch layout of the intermediate transfer belt are determined in consideration of a contact position of the leading end of the recording material with respect to the intermediate transfer belt at the upstream of the secondary transfer portion.

On the other hand, along with the diversification of recording materials in a commercial printing market, for example, it has been recently demanded to perform desirable transfer onto a wide variety of recording materials including thick paper with high rigidity and thin paper with low rigidity. Especially in a case where a recording material with high rigidity such as thick paper is used, when the recording material reaches the above-described contact position, the intermediate transfer belt easily deforms. A tiny airspace is thereby formed between the intermediate transfer belt and the recording material at the upstream of the secondary transfer portion, and an image defect caused by electric discharge in the airspace sometimes occurs. It is accordingly demanded to suppress the deformation of the intermediate transfer belt at the upstream of the secondary transfer portion and accurately form a desired shape (orientation) of an intermediate transfer belt at the upstream of the secondary transfer portion.

Japanese Patent Application Laid-Open No. H9-80926 discusses a configuration including a planarity correction member pressing an intermediate transfer belt with being in contact with the inner circumferential surface of the intermediate transfer belt that is provided at the upstream of a contact position (tacking position) of the leading end of a recording material with respect to the intermediate transfer belt in the rotational direction of the intermediate transfer belt. In Japanese Patent Application Laid-Open No. H9-80926, a flexible baffle plate or an elastic roll is used as the planarity correction member.

As described above, by providing a pressing member pressing the intermediate transfer belt with being in contact with the inner circumferential surface of the intermediate transfer belt, at the upstream of the secondary transfer portion, the shape of the intermediate transfer belt at the upstream of the secondary transfer portion can be controlled to be a predetermined shape.

However, if the position of the pressing member is set to a predetermined position, the shape of the intermediate transfer belt at the upstream of the secondary transfer portion sometimes varies for each individual image forming apparatus, or for each replacement unit such as an intermediate transfer belt unit. This is because a deflection amount of the pressing member varies due to variations in material characteristics (physicality) or the dimension of the pressing member, and the tension of the intermediate transfer belt. Then, if the shape (orientation) of the intermediate transfer belt at the upstream of the secondary transfer portion varies, a contact length between the intermediate transfer belt and the recording material at the upstream of the secondary transfer portion deviates from an appropriate value, and this sometimes causes the above-described image defect.

The above description has been given of a conventional issue using, as an example, a secondary transfer portion, which is a transfer portion of a toner image from an intermediate transfer belt onto a recording material. A similar issue can be caused also in a transfer portion of a toner image from another belt-like image bearing member such as a photosensitive member onto a recording material.

SUMMARY

The present disclosure is directed to an image forming apparatus that can prevent an image defect caused by a variation in the shape of a belt at the upstream of a transfer portion in a rotational direction of the belt.

According to an aspect of the present disclosure, an image forming apparatus includes a belt that is rotatable and endless, and configured to bear a toner image, a plurality of tension rollers including an inner roller and an upstream roller arranged adjacently to the inner roller at an upstream of the inner roller in a rotational direction of the belt, wherein the plurality of tension rollers is configured to stretch the belt around the inner roller and the upstream roller, an outer member arranged to face the inner roller via the belt and configured to form a transfer portion at which the toner image is transferred from the belt in cooperation with the inner roller onto a recording material, a pressing member configured to contact an inner circumferential surface of the belt at the upstream of the inner roller and a downstream of the upstream roller in the rotational direction of the belt, and press the inner circumferential surface of the belt toward an outer circumferential surface side, a moving mechanism including a moving unit movable so as to move the pressing member in a direction for pressing the belt and a direction opposite to the direction for pressing the belt, an attachable unit including at least one of the pressing member or the belt and configured to be attached to and detached from the image forming apparatus, a control unit configured to execute a mode for transferring the toner image from the belt onto the recording material by pressing the belt using the pressing member, and a storage unit configured to store information that is based on an individual difference of the attachable unit that is related to a setting of a position of the moving unit, wherein the control unit sets the position of the moving unit in executing the mode for transferring the toner image based on the information stored in the storage unit.

Further features of the present disclosure will become apparent from the following description of exemplary embodiments with reference to the attached drawings.

DESCRIPTION OF THE EMBODIMENTS

Hereinafter, an image forming apparatus according to an exemplary embodiment of the present disclosure will be described in detail with reference to the drawings.

1. Overall Configuration and Operation of Image Forming Apparatus

Figure 1:
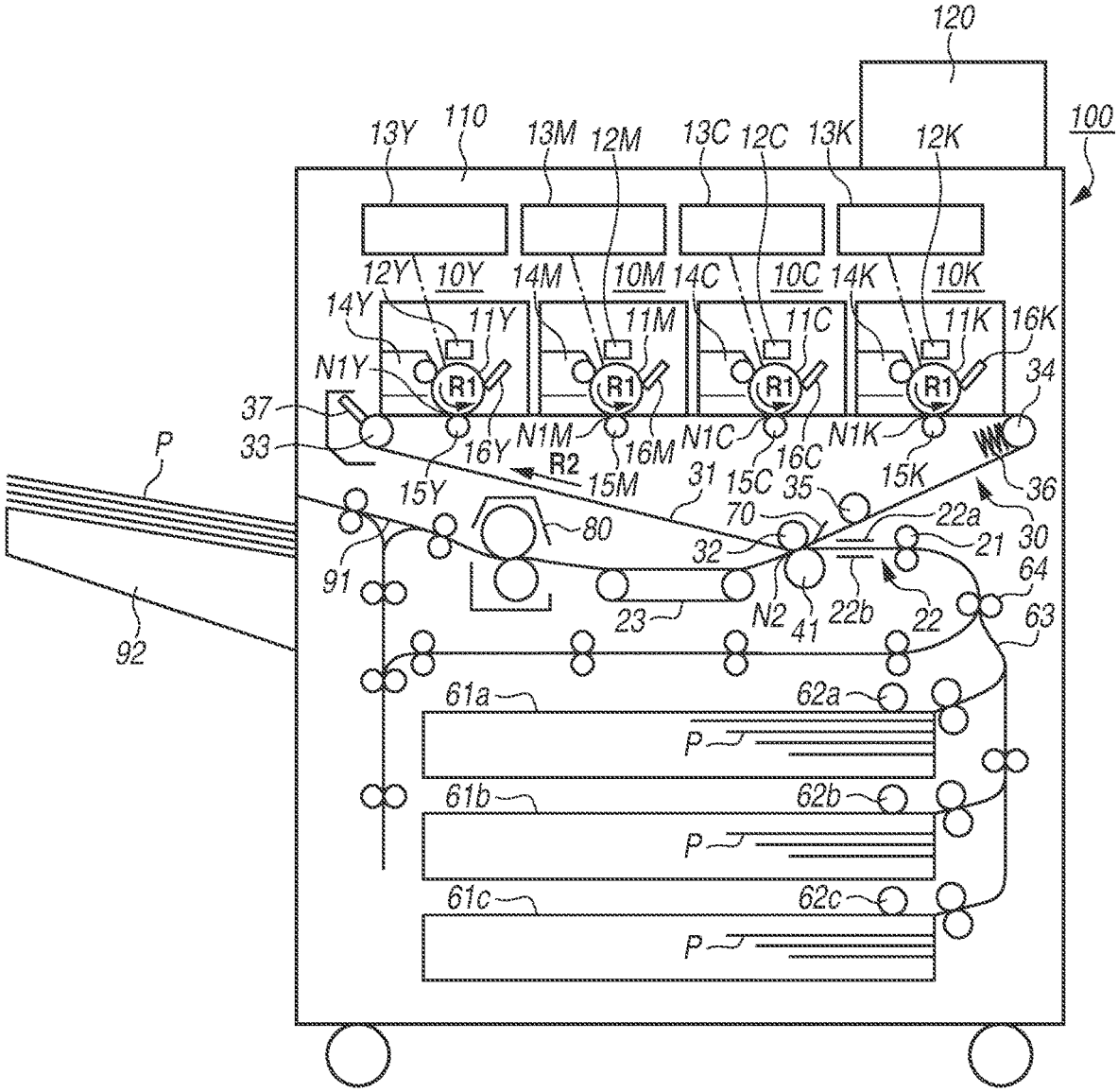
FIG. 1 is a schematic cross-sectional view of an image forming apparatus.

FIG. 1 is a schematic cross-sectional view of an image forming apparatus 100 according to a first exemplary embodiment. The image forming apparatus 100 according to the present exemplary embodiment is a tandem-type printer employing an intermediate transfer system. Based on an image signal transmitted from an external apparatus such as a personal computer, the image forming apparatus 100 can form a full-color image onto a sheet-like recording material (transfer material, sheet, recording medium, media) P such as paper using an electrophotographic method.

The image forming apparatus 100 includes, as a plurality of image forming units (stations), four image forming units 10Y, 10M, 10C, and 10K that respectively form yellow (Y), magenta (M), cyan (C), and black (K) images. These image forming units 10Y, 10M, 10C, and 10K are arranged in a line along a moving direction of an image transfer surface arranged substantially horizontal to an intermediate transfer belt 31 to be described below. Components having the same or corresponding functions or configurations that are provided in the respective image forming units 10Y, 10M, 10C, and 10K will be sometimes collectively described excluding the letters Y, M, C, and K added to the ends of the reference numerals for indicating the colors of the components. In the present exemplary embodiment, the image forming units 10 include photosensitive drums 11 (11Y, 11M, 11C, and 11K), charging devices 12 (12Y, 12M, 12C, and 12K), exposure devices 13 (13Y, 13M, 13C, and 13K), development devices 14 (14Y, 14M, 14C, and 14K), primary transfer rollers 15 (15Y, 15M, 15C, and 15K), and cleaning devices 16 (16Y, 16M, 16C, and 16K), which will be described below.

The image forming apparatus 100 includes the photosensitive drum 11, which is a rotatable drum-shaped (cylindrical) photosensitive member (electrophotographic photosensitive member) serving as a first image bearing member bearing a toner image. If a drive force is transmitted to the photosensitive drum 11 from a drum drive motor (not illustrated) serving as a drive source, the photosensitive drum 11 is rotationally driven in an arrow R1 direction in FIG. 1 (counterclockwise direction) at a predetermined circumferential speed (process speed). The surface of the rotating photosensitive drum 11 is uniformly charged to a predetermined potential with a predetermined polarity (negative polarity in the present exemplary embodiment) by the charging device 12 serving as a charging unit. During the charging processing, a predetermined charging voltage (charging bias) is applied to the charging device 12 by a charging power source (not illustrated).

The charged surface of the photosensitive drum 11 is subjected to scanning exposure performed by the exposure device 13 serving as an exposure unit, based on an image signal, and an electrostatic image (electrostatic latent image) is formed on the photosensitive drum 11. In the present exemplary embodiment, the exposure device 13 is a laser scanner device that emits laser light modulated based on the image signal (image information), onto the photosensitive drum 11. The electrostatic image formed on the photosensitive drum 11 is developed (visualized) by being supplied with toner serving as developer, by the development device 14 serving as a development unit, and a toner image (developer image) is formed on the photosensitive drum 11. In the present exemplary embodiment, toner charged to the same polarity (negative polarity in the present exemplary embodiment) as the charging polarity of the photosensitive drum 11 adheres to an exposed portion (image portion) on the photosensitive drum 11 with an absolute value of a potential lowered by being exposed after being uniformly charged (reverse development). At the time of development, a predetermined development voltage (development bias) is applied by a development power source (not illustrated) to a development roller serving as a developer bearing member that is included in the development device 14. In the present exemplary embodiment, regular charging polarity of toner, which is the charging polarity of toner in development, is the negative polarity.

The intermediate transfer belt 31, which is a rotatable intermediate transfer member formed by an endless belt and serving as a second image bearing member bearing a toner image, is arranged to face the four photosensitive drums 11Y, 11M, 11C, and 11K. The intermediate transfer belt 31 is stretched around, with a predetermined tension (tensional force), a drive roller 33, a tension roller 34, a pre-secondary transfer roller 35, and a secondary transfer inner roller 32 that serve as a plurality of tension rollers (support rollers). The drive roller 33 transmits a drive force to the intermediate transfer belt 31. If a drive force is transmitted to the drive roller 33 from a belt drive motor (not illustrated) serving as a drive source, the drive roller 33 is rotationally driven. The drive force is thereby input to the intermediate transfer belt 31 from the drive roller 33, and the intermediate transfer belt 31 rotates (revolves) in an arrow R2 direction in FIG. 1 (clockwise direction) at a circumferential speed (process speed) corresponding to the circumferential speed of the photosensitive drum 11. The tension roller 34 controls the tension of the intermediate transfer belt 31 to be constant, by adding a predetermined tension to the intermediate transfer belt 31. At both ends thereof in its rotational axis direction, the tension roller 34 is urged from the inner circumferential surface side toward the outer circumferential surface side of the intermediate transfer belt 31 by a tension spring 36 made of a compression coil spring being an urging member serving as a tensional force adding unit (urging unit). The pre-secondary transfer roller 35 forms the surface of the intermediate transfer belt 31 in the upstream vicinity of a secondary transfer portion N2 (described below) in the rotational direction of the intermediate transfer belt 31 (moving direction of the surface). In the present exemplary embodiment, the secondary transfer inner roller (inner member) 32 functions as a secondary transfer member serving as a secondary transfer unit. Among the plurality of tension rollers, tension rollers other than the drive roller 33 are driven to rotate following the rotation of the intermediate transfer belt 31. In addition, the primary transfer rollers 15Y, 15M, 15C, and 15K, which are roller-shaped primary transfer members each serving as a primary transfer unit, are arranged on the inner circumferential surface side of the intermediate transfer belt 31 to face the respective photosensitive drums 11Y, 11M, 11C, and 11K. The primary transfer roller 15 forms a primary transfer portion (primary transfer nip) N1 that is a contact portion between the photosensitive drum 11 and the intermediate transfer belt 31, by pressing the intermediate transfer belt 31 toward the photosensitive drum 11. In addition, a pressing member 70 is provided on the inner circumferential surface side of the intermediate transfer belt 31 at the upstream of the secondary transfer inner roller 32 and the downstream of the pre-secondary transfer roller 35 in the rotational direction of the intermediate transfer belt 31. The pressing member 70 and a moving mechanism 71 (FIG. 3) that changes the position of the pressing member 70 will be described in more detail below.

The toner image formed on the photosensitive drum 11 as described above is primarily transferred onto the rotating intermediate transfer belt 31 at the primary transfer portion N1. At the time of primary transfer, a primary transfer voltage (primary transfer bias), which is a direct-current voltage with a reverse polarity (positive polarity in the present exemplary embodiment) to the regular charging polarity of toner is applied to the primary transfer roller 15 by a primary transfer power source (not illustrated). For example, when a full-color image is to be formed, yellow, magenta, cyan, and black toner images formed on the respective photosensitive drums 11 are sequentially primarily transferred onto the same image formation region on the intermediate transfer belt 31 in an overlapped manner. In the present exemplary embodiment, the primary transfer portion N1 is an image forming position at which a toner image is formed onto the intermediate transfer belt 31. Then, the intermediate transfer belt 31 is an example of a rotatable endless belt that bears and conveys a toner image formed at the image forming position.

A secondary transfer outer roller (outer member) 41 is arranged on the outer circumferential surface side of the intermediate transfer belt 31 at a position facing the secondary transfer inner roller 32. In the present exemplary embodiment, the secondary transfer outer roller 41 functions as a counter member (counter electrode) of the secondary transfer inner roller 32. The secondary transfer outer roller 41 forms the secondary transfer portion (secondary transfer nip) N2 that is a contact portion between the intermediate transfer belt 31 and the secondary transfer outer roller 41, by being pressed toward the secondary transfer inner roller 32 via the intermediate transfer belt 31. At the secondary transfer portion N2, the toner image formed on the intermediate transfer belt 31 as described above is secondarily transferred onto the recording material P that is nipped between the intermediate transfer belt 31 and the secondary transfer outer roller 41 and conveyed. In the present exemplary embodiment, at the time of secondary transfer, a secondary transfer voltage (secondary transfer bias) that is a direct-current voltage with the same polarity (negative polarity in the present exemplary embodiment) as the regular charging polarity of toner is applied to the secondary transfer inner roller 32 by a secondary transfer power source (not illustrated). In the present exemplary embodiment, the secondary transfer outer roller 41 is electrically grounded (connected to a ground). Alternatively, the secondary transfer outer roller 41 may be used as a secondary transfer member, and a secondary transfer voltage with the reverse polarity to the regular charging polarity of toner may be applied to the secondary transfer outer roller 41. In this case, the secondary transfer inner roller 32 may be used as a counter electrode and electrically grounded.

The recording materials P are stored in recording material cassettes 61*a* to 61*c* each serving as a recording material storage unit.

The recording material P stored in any of the recording material cassettes 61*a* to 61*c* is fed to a feeding conveyance path 63 when a corresponding one of feeding rollers 62*a* to 62*c* that are feeding members each serving as a feeding unit is rotationally driven. The recording material P is conveyed by a conveyance roller pair 64, which is a conveyance member serving as a conveyance unit, to a registration roller pair 21 that is a conveyance member serving as a conveyance unit, and paused by the registration roller pair 21. If the registration roller pair 21 is rotationally driven, the recording material P is fed to the secondary transfer portion N2 in synchronization with the toner image on the intermediate transfer belt 31.

A conveyance guide (pre-transfer guide) 22 for guiding the recording material P to the secondary transfer portion N2 is provided at the downstream of the registration roller pair 21 and the upstream of the secondary transfer portion N2 in the conveyance direction of the recording material P. The conveyance guide 22 includes a first guide member 22*a* contactable to the front surface of the recording material P (surface onto which a toner image is to be transferred immediately after the recording material P passes through the conveyance guide 22), and a second guide member 22*b* contactable to the rear surface of the recording material P (surface on the opposite side of the front surface). The first guide member 22*a* and the second guide member 22*b* are arranged facing each other, and the recording material P passes through between these members. The first guide member 22*a* regulates the movement of the recording material P in a direction to be closer to the intermediate transfer belt 31. The second guide member 22*b* regulates the movement of the recording material P in a direction to be away from the intermediate transfer belt 31.

The recording material P bearing the transferred toner image is conveyed to a fixing device 80 serving as a fixing unit, by a conveyance belt (pre-fixing conveyance device) 23. By a fixing rotary member pair sandwiching and conveying the recording material P bearing the unfixed toner image, the fixing device 80 applies heat and pressure to the recording material P, and fixes (melts, bonds) the toner image onto the surface of the recording material P. The recording material P bearing the fixed toner image is discharged (output) to a discharge tray 92 provided outside of an apparatus main body 110 of the image forming apparatus 100 through a discharge conveyance path 91.

On the other hand, an adhering substance such as toner (primary transfer residual toner) remaining on the photosensitive drum 11 after primary transfer is removed from the surface of the photosensitive drum 11 and collected by a cleaning device 16 serving as a cleaning unit. An adhering substance such as toner (secondary transfer residual toner) remaining on the intermediate transfer belt 31 after secondary transfer is removed from the surface of the intermediate transfer belt 31 and collected by a belt cleaning device 37 serving as an intermediate transfer member cleaning unit.

In the present exemplary embodiment, an intermediate transfer belt unit 30 serving as a belt conveyance device includes the intermediate transfer belt 31, the tension rollers 32 to 35, the primary transfer rollers 15, the belt cleaning device 37, and a frame (not illustrated) supporting these components. In the present exemplary embodiment, the intermediate transfer belt unit 30 further includes the pressing member 70 to be described in detail below, and the moving mechanism 71 (FIG. 3) that changes the position of the pressing member 70. The intermediate transfer belt unit 30 is attachable to and detachable from the apparatus main body 110 of the image forming apparatus 100 for maintenance or replacement.

As the intermediate transfer belt 31, an intermediate transfer belt including single-layered or multilayered resin-based material, or an intermediate transfer belt having a multilayered structure including a resin layer formed of resin material, and an elastic layer formed of elastic material. In the present exemplary embodiment, the secondary transfer inner roller 32 includes a metal core (core member) and an elastic layer formed of electronically conductive rubber provided on the outer circumferential of the metal core. In the present exemplary embodiment, the pre-secondary transfer roller 35 is a metal roller. In the present exemplary embodiment, the secondary transfer outer roller 41 includes a metal core (core member) and an elastic layer formed of ion conductive foam rubber provided on the outer circumferential of the metal core. In the present exemplary embodiment, a bearing member (not illustrated) pivotally supporting both ends in the rotational axis direction of the secondary transfer outer roller 41 is made slidable in a direction toward the secondary transfer inner roller 32, and an opposite direction thereof. The bearing member is pressed toward the secondary transfer inner roller 32 by a pressing spring 42 (FIGS. 2A and 2B) formed of a compression coil spring that is an urging member (elastic member) serving as an urging unit. The secondary transfer outer roller 41 thereby contacts the secondary transfer inner roller 32 with a predetermined pressure via the intermediate transfer belt 31, and forms the secondary transfer portion N2. The rotational axis directions of the tension rollers of the intermediate transfer belt 31 including the secondary transfer inner roller 32, and the secondary transfer outer roller 41 are substantially parallel to each other.

Figure 2A:
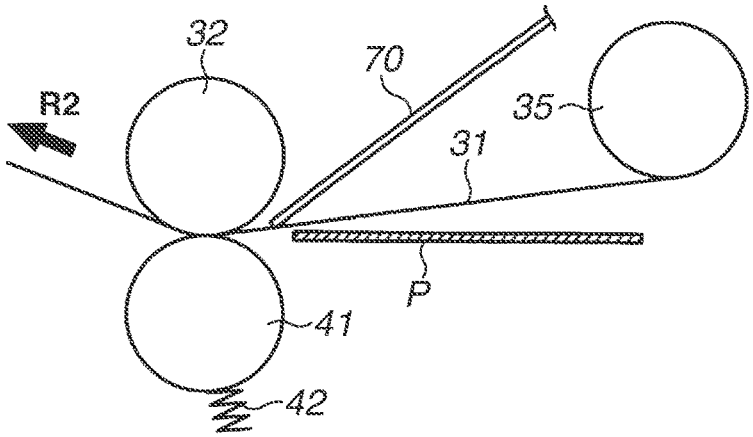
FIGS. 2A, 2B, and 2C are schematic cross-sectional views of a vicinity of a secondary transfer portion.
Figure 2B:
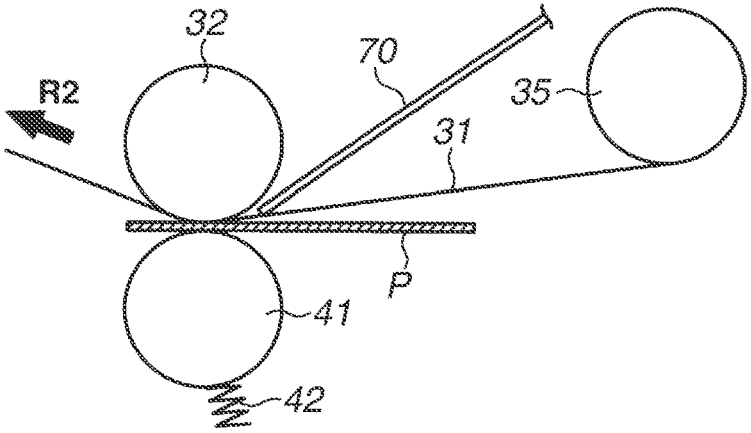
Figure 2C:
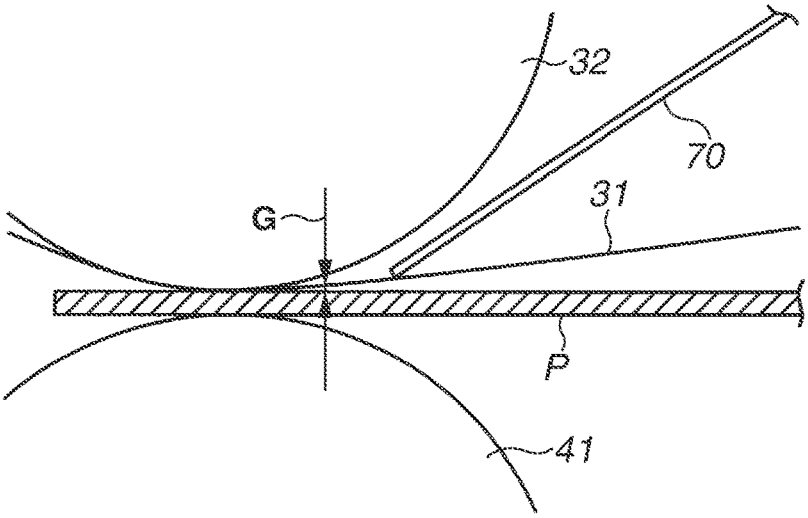
Figure 13A:
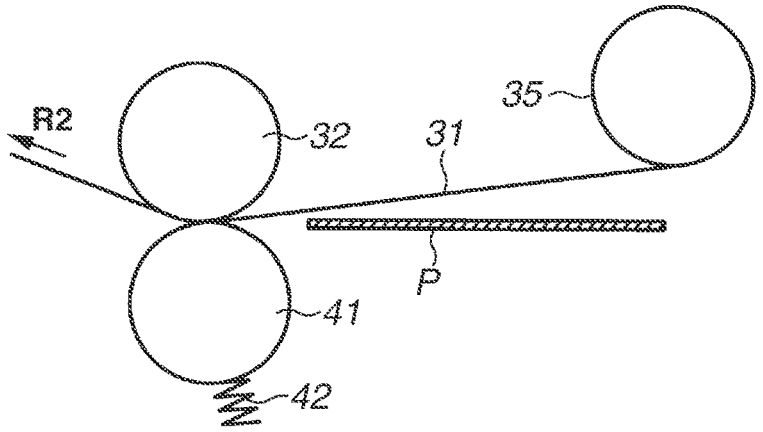
FIGS. 13A, 13B, and 13C are schematic cross-sectional views illustrating an issue caused in a case where a pressing member is not provided.
Figure 13B:
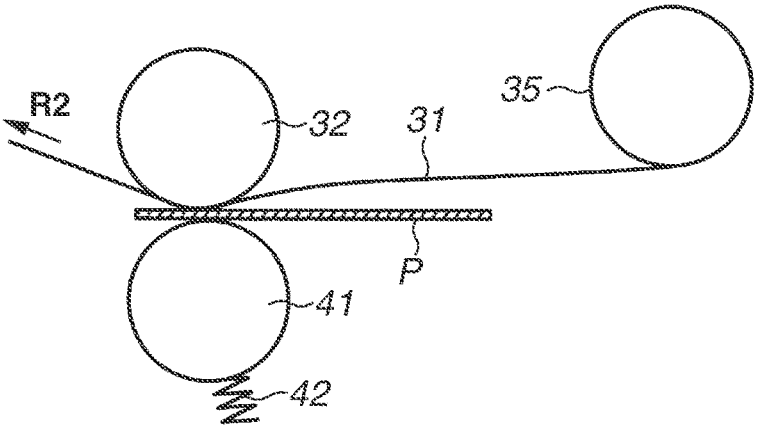
Figure 13C:
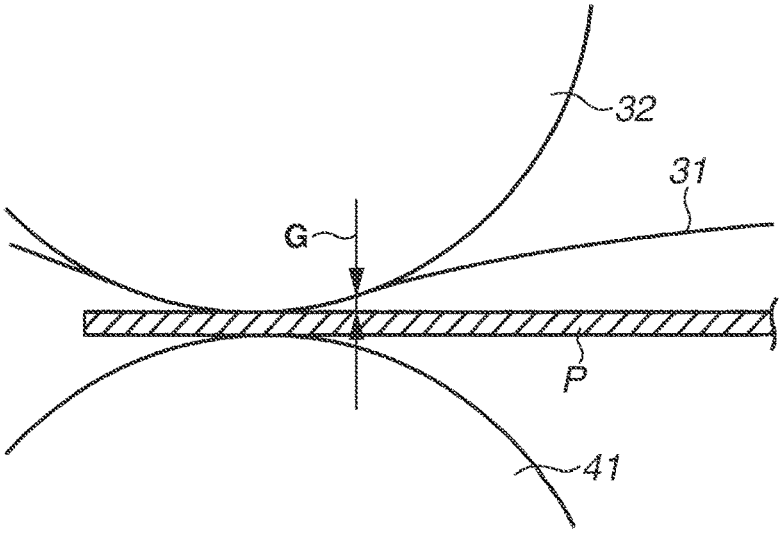

2. Shape of Intermediate Transfer Belt at Upstream of Secondary Transfer Portion Next, the shape (orientation) of the intermediate transfer belt 31 at the upstream of the secondary transfer portion N2 will be described. FIGS. 2A, 2B, and 2C are schematic cross-sectional views illustrating the shape of the intermediate transfer belt 31 at the upstream of the secondary transfer portion N2 in the image forming apparatus 100 according to the present exemplary embodiment (cross-section substantially orthogonal to the rotational axis direction of the secondary transfer inner roller 32). FIGS. 13A, 13B, and 13C are schematic cross-sectional views illustrating the shape of the intermediate transfer belt 31 at the upstream of the secondary transfer portion N2 in a configuration according to a comparative example in which the pressing member 70 is not provided (cross-section substantially orthogonal to the rotational axis direction of the secondary transfer inner roller 32). Also in the comparative example, the components corresponding to those in the present exemplary embodiment are assigned the same reference numerals.

FIG. 2A illustrates a state before the recording material P moves to the secondary transfer portion N2, FIG. 2B illustrates a state after the recording material P has moved to the secondary transfer portion N2, and FIG. 2C illustrates an enlarged view of the vicinity of the secondary transfer portion N2 in FIG. 2B. Similarly, FIG. 13A illustrates a state before the recording material P moves to the secondary transfer portion N2, FIG. 13B illustrates a state after the recording material P has moved to the secondary transfer portion N2, and FIG. 13C illustrates an enlarged view of the vicinity of the secondary transfer portion N2 in FIG. 13B.

In the present exemplary embodiment, as illustrated in FIGS. 2A, 2B, and 2C, with respect to the shape of the intermediate transfer belt 31 that is formed by being stretched by the secondary transfer inner roller 32 and the pre-secondary transfer roller 35, the secondary transfer outer roller 41 is elastically urged toward the secondary transfer inner roller 32 by the pressing spring 42. The intermediate transfer belt 31 is thereby nipped between the secondary transfer inner roller 32 and the secondary transfer outer roller 41, to form the secondary transfer portion N2.

In the present exemplary embodiment, as described in detail below, the pressing member 70 is provided close to the secondary transfer inner roller 32 at the upstream of the secondary transfer portion N2. In the present exemplary embodiment, at the time of image formation (secondary transfer) in at least one predetermined mode, the leading end portion of the pressing member 70 and the inner circumferential surface of the intermediate transfer belt 31 are brought into contact. The pressing member 70 can press the intermediate transfer belt 31 from the inner circumferential surface side toward the outer circumferential surface side in contact with the inner circumferential surface of the intermediate transfer belt 31.

The pressing member 70 can thereby cause a stretched surface of the intermediate transfer belt 31 that is formed between the secondary transfer inner roller 32 and the pre-secondary transfer roller 35, to protrude from the inner circumferential surface side toward the outer circumferential surface side of the intermediate transfer belt 31. In the present exemplary embodiment, the pressing member 70 is formed by a resin plate-like member, and elastically urges the intermediate transfer belt 31 using deflecting elasticity of the pressing member 70. Thus, when the pressing member 70 presses the intermediate transfer belt 31, the shape (deflection amount, deformation amount) of the pressing member 70 is determined to be a shape (hereinafter, will also be referred to as a "statically-determinate shape") in which the urging force of the pressing member 70 urging the intermediate transfer belt 31, and the drag generated by the tensional force of the intermediate transfer belt 31 balance out, and the shape of the intermediate transfer belt 31 at the upstream of the secondary transfer portion N2 is formed by the statically-determinate shape of the pressing member 70.

Figure 3:
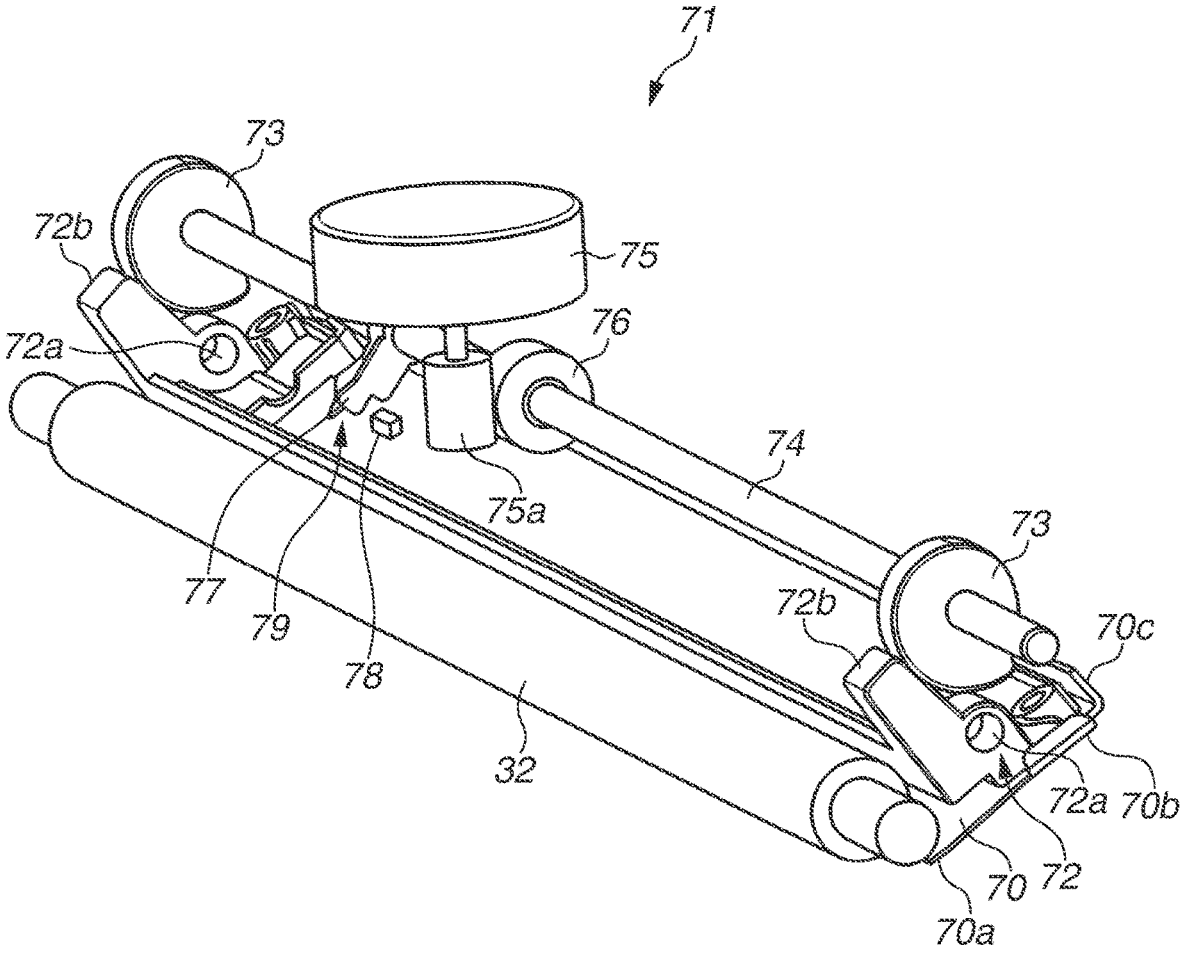
FIG. 3 is a schematic perspective view of a moving mechanism.

In the present exemplary embodiment, as described in detail below, the image forming apparatus 100 can change the position of the pressing member 70 by the action of the moving mechanism 71 (FIG. 3). With this configuration, in the present exemplary embodiment, the image forming apparatus 100 can control the statically-determinate shape of the pressing member 70, i.e., the shape of the intermediate transfer belt 31 at the upstream of the secondary transfer portion N2.

In the present exemplary embodiment, a bias with the same polarity as the charging polarity of toner forming a toner image on the intermediate transfer belt 31 is applied to the secondary transfer inner roller 32, and the secondary transfer outer roller 41 is connected to the ground. A transfer electrical field is thereby formed at the secondary transfer portion N2. While being guided by the conveyance guide 22 (FIG. 1), the recording material P is fed to the secondary transfer portion N2 at which the transfer electrical field is formed. As illustrated in FIG. 2A, the recording material P contacts the intermediate transfer belt 31 at its leading end at the upstream of the secondary transfer portion N2, and is further conveyed toward the secondary transfer portion N2 in a state of being in contact with the toner image formed on the surface of the intermediate transfer belt 31. Then, as illustrated in FIG. 2B, if the recording material P is conveyed to the secondary transfer portion N2, by the pressure action between the secondary transfer inner roller 32 and the secondary transfer outer roller 41, and the electric action caused by the transfer electrical field, the toner image is transferred from the intermediate transfer belt 31 onto the recording material P.

For executing accurate secondary transfer, a length (hereinafter, will also be referred to as a "contact length") by which the intermediate transfer belt 31 and the recording material P are brought into contact in the rotational direction of the intermediate transfer belt 31 at the upstream of the secondary transfer portion N2 when the recording material P is conveyed to the secondary transfer portion N2 is important. In a case where the contact length is long, an image defect might occur due to sliding friction between the toner image formed on the surface of the intermediate transfer belt 31, and the recording material P. On the other hand, in a case where the contact length is short, an airspace (clearance gap) G (FIG. 2C) between the intermediate transfer belt 31 and the recording material P becomes large, and an image defect might occur due to an electric discharge phenomenon occurring in the airspace G.

Especially in a case where the recording material P with high rigidity such as thick paper or coated paper is used, when the recording material P reaches a contact position of the leading end of the recording material P with respect to the intermediate transfer belt 31 at the upstream of the secondary transfer portion N2, the intermediate transfer belt 31 easily deforms. This causes the above-described airspace G to be generated easily, and also causes an image defect to easily occur due to electric discharge in the airspace G in some cases.

By providing the pressing member 70 as in the present exemplary embodiment, it becomes easier to appropriately set the contact length between the intermediate transfer belt 31 and the recording material P at the upstream of the secondary transfer portion N2. Especially in the present exemplary embodiment, by performing variable control of the position of the pressing member 70 by the moving mechanism 71 to be described in detail below, the shape of the intermediate transfer belt 31 at the upstream of the secondary transfer portion N2 can be controlled. With this configuration, by optimizing the contact length between the intermediate transfer belt 31 and the recording material P at the upstream of the secondary transfer portion N2, a toner image can be stably secondarily transferred. Furthermore, also in a case where the recording material P with high rigidity such as thick paper or coated paper is used, by the effect caused by elastic urging of the pressing member 70, it is possible to suppress the deformation of the intermediate transfer belt 31 that is caused when the recording material P and the intermediate transfer belt 31 contact, and prevent the airspace G between the intermediate transfer belt 31 and the recording material P from becoming larger.

On the other hand, as illustrated in FIGS. 13A to 13C, in a case where the pressing member 70 is not provided, when the recording material P is conveyed to the secondary transfer portion N2, the intermediate transfer belt 31 deforms at the upstream of the secondary transfer portion N2, and the airspace G between the intermediate transfer belt 31 and the recording material P becomes larger in some cases. Then, an image defect due to electric discharge caused by the airspace G becoming larger sometimes occurs.

As described above, such an image defect is likely to occur especially in a case where the recording material P with high rigidity such as thick paper or coated paper is used.

In this manner, the image forming apparatus 100 according to the present exemplary embodiment can provide a product with stable image quality by the action of the pressing member 70. The image forming apparatus 100 according to the present exemplary embodiment can also provide a product with high image quality by the action of the pressing member 70 even in a case where the recording material P with high rigidity such as thick paper or coated paper is used.

The image forming apparatus 100 according to the present exemplary embodiment is an apparatus that realizes high productivity, and the intermediate transfer belt 31 is conveyed at the speed of 400 mm/s. In the image forming apparatus 100 according to the present exemplary embodiment, toner has the negative polarity. In addition, in the image forming apparatus 100 according to the present exemplary embodiment, a high-voltage bias of −10 [kV] is applied to the secondary transfer inner roller 32 for ensuring appropriate transfer performance even at the conveyance speed of the intermediate transfer belt 31. The conveyance speed of the intermediate transfer belt 31, the polarity of toner, and the value of the secondary transfer voltage are not limited thereto.

3. Pressing Member and Moving Mechanism

Figure 4A:
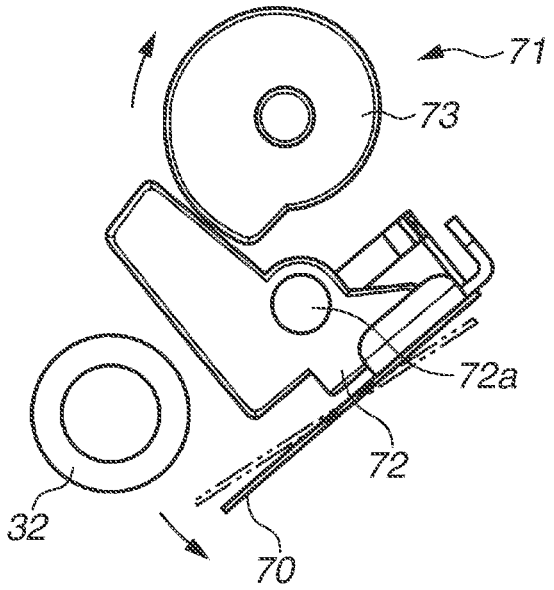
FIGS. 4A and 4B are schematic diagrams illustrating an operation of the moving mechanism.
Figure 4B:
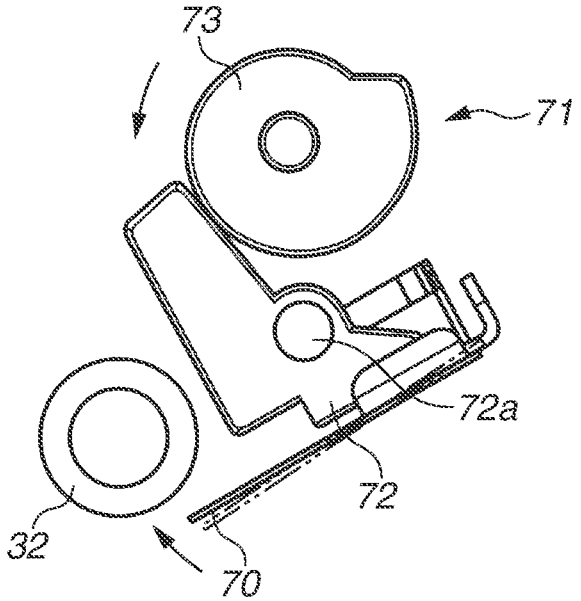

Next, the pressing member 70 according to the present exemplary embodiment, and the moving mechanism 71 that changes the position of the pressing member 70 will be described. FIG. 3 is a schematic perspective view illustrating the pressing member 70 and the moving mechanism 71 according to the present exemplary embodiment. FIGS. 4A and 4B are schematic side views illustrating an operation of the moving mechanism 71 according to the present exemplary embodiment. FIGS. 4A and 4B illustrate the vicinity of the pressing member 70 viewed in a direction substantially parallel to the rotational axis direction of the secondary transfer inner roller 32 from the one end side in the rotational axis direction (front side in FIG. 1). For the sake of explanatory convenience, FIGS. 4A and 4B illustrate a state where the intermediate transfer belt 31 is not provided.

<Pressing Member>

In the present exemplary embodiment, the image forming apparatus 100 includes the pressing member (backup member) 70 on the inner circumferential surface side of the intermediate transfer belt 31 in the upstream vicinity of the secondary transfer portion N2. In the entry vicinity of the secondary transfer portion N2, the pressing member 70 can cause the intermediate transfer belt 31 to protrude toward the outer circumferential surface side by pressing the inner circumferential surface of the intermediate transfer belt 31. The pressing member 70 is arranged at the upstream of the secondary transfer inner roller 32 and the downstream of the pre-secondary transfer roller 35 in the rotational direction of the intermediate transfer belt 31 to be contactable to the inner circumferential surface of the intermediate transfer belt 31. Especially in the present exemplary embodiment, the pressing member 70 is arranged at the upstream of the secondary transfer inner roller 32 and the downstream of the leading end on the downstream side of the conveyance guide 22 (first guide member 22*a*) in the conveyance direction of the recording material P to be contactable to the inner circumferential surface of the intermediate transfer belt 31.

In the present exemplary embodiment, the pressing member 70 is formed by a plate-like (sheet-like) member having a substantially rectangular shape in a planer view and a predetermined thickness, and each having a predetermined length in a longitudinal direction arranged substantially parallel to a width direction of the intermediate transfer belt 31, and in a transverse direction substantially orthogonal to the longitudinal direction. The width direction of the intermediate transfer belt 31 is a direction substantially orthogonal to the moving direction of the surface of the intermediate transfer belt 31, and is a direction substantially parallel to the rotational axis direction of the secondary transfer inner roller 32. The length in the longitudinal direction of the pressing member 70 is equivalent to the length in the width direction of the intermediate transfer belt 31. A free end portion (leading end portion) 70*a* of the pressing member 70, which is one end in the transverse direction (end on the downstream side in the rotational direction of the intermediate transfer belt 31), can contact the inner circumferential surface of the intermediate transfer belt 31 over the substantially entire width of the intermediate transfer belt 31, and can press the intermediate transfer belt 31. In the present exemplary embodiment, a part of a fixed end portion (base end portion) 70*b* of the pressing member 70, which is a different end in the transverse direction (an end on the upstream side in the rotational direction of the intermediate transfer belt 31), is fixed to an attaching portion 70*c* by adhesive bonding. In the present exemplary embodiment, the attaching portion 70*c* is formed by a plate including a plate-like portion extending in the width direction of the intermediate transfer belt 31 (longitudinal direction of the pressing member 70), and is used for attaching the pressing member 70 to the moving mechanism 71 to be described below.

The pressing member 70 can be formed using resin material. In the present exemplary embodiment, the pressing member 70 is formed of polyphenylene sulfide (PPS) with a thickness of 0.5 mm. The pressing member 70 elastically urges the intermediate transfer belt 31 using deflecting elasticity. The configuration of the pressing member 70 is not limited to the configuration in the present exemplary embodiment, and the pressing member 70 is only required to be able to elastically urge the intermediate transfer belt 31. For example, the thickness of the pressing member 70 is not limited to 0.5 mm. The thickness of the pressing member 70 is desirably about 0.4 to 1.5 mm. For example, the thickness of the pressing member 70 may be 1.0 mm. The material of the pressing member 70 is not limited to PPS, and may be polyether ether ketone (PEEK) or polyethylene terephthalate (PET). A metal thin plate can be used as the pressing member 70. For example, by urging the pressing member 70 formed of a plate with relatively-high rigidity, using an urging member (compression coil spring, tension spring, etc.), the intermediate transfer belt 31 may be elastically urged by the pressing member 70.

It is desirable that the pressing member 70, more specifically, the end (hereinafter, will be simply referred to as a "leading end") on the free end portion (leading end) 70*a* side in the transverse direction of the pressing member 70 is arranged in proximity to the secondary transfer inner roller 32 as far as possible. At this time, the pressing member 70 is arranged so as not to contact the secondary transfer inner roller 32. The pressing member 70 is arranged so as to contact the inner circumferential surface of the intermediate transfer belt 31 at a position separated by about 2 mm or more, for example, or typically about 10 mm or more toward the upstream side in the rotational direction of the intermediate transfer belt 31 from a position at which the secondary transfer inner roller 32 and the intermediate transfer belt 31 contact. The pressing member 70 is arranged, for example, so as to contact the inner circumferential surface of the intermediate transfer belt 31 at a position separated by about 40 mm or less or typically about 25 mm or less toward the upstream side in the rotational direction of the intermediate transfer belt 31 from a position at which the secondary transfer inner roller 32 and the intermediate transfer belt 31 contact.

It is considered that, for example, a roller formed by an elastic member such as sponge or rubber, or a roller formed by a rigid member such as resin or metal is used as a pressing member. In this case, it becomes difficult to arrange the pressing member in proximity to the secondary transfer portion N2 to a sufficient extent. If the pressing member is distant from the secondary transfer portion N2, the surface of the intermediate transfer belt 31 that is formed by the pressing member and the secondary transfer inner roller 32 deforms relatively easily, and the effect caused by providing the pressing member might become insufficient.

<Moving Mechanism>

In the present exemplary embodiment, the image forming apparatus 100 includes the moving mechanism 71 that changes the position of the pressing member 70. By changing the position of the pressing member 70, the moving mechanism 71 can control a statically-determinate shape of the pressing member 70, i.e., the shape of the intermediate transfer belt 31 at the upstream of the secondary transfer portion N2. The moving mechanism 71 can thereby optimize a contact length between the intermediate transfer belt 31 and the recording material P at the upstream of the secondary transfer portion N2. In other words, by changing the position of the pressing member 70, the moving mechanism 71 can control a pressing amount (intrusion amount to be described below) of the pressing member 70. In the present exemplary embodiment, by changing the position of the pressing member 70, the moving mechanism 71 can change a contact state or a separated state of the pressing member 70 with respect to the intermediate transfer belt 31.

The moving mechanism 71 includes a supporting member 72 extending in the width direction of the intermediate transfer belt 31.

The pressing member 70 is fixed to the supporting member 72. In the present exemplary embodiment, a part on the fixed end portion 70*b* side of the pressing member 70 in the transverse direction is fixed to the attaching portion 70*c* by adhesive bonding over the substantially entire width in the longitudinal direction, and the attaching portion 70*c* is fixed to the supporting member 72 by a screw. Supporting holes 72*a*, which are cylindrical holes, are provided at both ends in the longitudinal direction of the supporting member 72. The supporting member 72 is supported by a frame (not illustrated) of the intermediate transfer belt unit 30 so as to be pivotable about a pivotal axis line substantially parallel to the width direction of the intermediate transfer belt 31 around the supporting holes 72*a*. In this way, by causing the supporting member 72 to pivot about the pivotal axis line substantially parallel to the width direction of the intermediate transfer belt 31, the pressing member 70 is caused to pivot about the pivotal axis line, and the position of the pressing member 70 can be accordingly changed.

The moving mechanism 71 further includes a cam shaft 74 formed by a cylindrical member extending in the width direction of the intermediate transfer belt 31. The cam shaft 74 is supported by the frame (not illustrated) of the intermediate transfer belt unit 30 so as to be rotatable about a rotational axis line substantially parallel to the width direction of the intermediate transfer belt 31. The moving mechanism 71 further includes cams 73, a transmission gear 76, and a detection flag 77. The cams 73, the transmission gear 76, and the detection flag 77 are fixed to the cam shaft 74. The cams 73 are provided at both ends in the rotational axis direction of the cam shaft 74. The moving mechanism 71 further includes a cam drive motor 75, which is a stepping motor, serving as a drive source. The cam drive motor 75 is fixed to the frame (not illustrated) of the intermediate transfer belt unit 30 in such a manner that a drive gear 75*a* fixed to its output end shaft engages with the transmission gear 76 fixed to the cam shaft 74. If the cam drive motor 75 rotates, drive force is transmitted to the cam shaft 74 via the transmission gear 76, and the cams 73, the transmission gear 76, and the detection flag 77 rotate about the rotational axis line substantially parallel to the width direction of the intermediate transfer belt 31, together with the cam shaft 74.

The cam 73 serving as an action unit is in contact with a cam follower 72*b* provided on the supporting member 72 serving as a moving unit. The cam 73 forms a non-step surface that uniformly changes in radius from the rotational center corresponding to its rotational angle. Thus, if the cam 73 rotates by the cam drive motor 75 rotating, the supporting member 72 rotates about the supporting hole 72*a* following the rotation of the cam 73. The moving mechanism 71 can thereby move the pressing member 70 and change the position of the pressing member 70. In the present exemplary embodiment, more specifically, changing the position of the pressing member 70 refers to changing the position of the leading end of the pressing member 70 (hereinafter, will also be simply referred to as a "leading end position") in a case where the intermediate transfer belt 31 is supposed to be absent. More specifically, in the present exemplary embodiment, changing the position of the pressing member 70 refers to changing the position of the supporting member 72 serving as a movable moving unit that is included in the moving mechanism 71 to be described below.

The moving mechanism 71 further includes a cam position sensor (cam HP sensor) 78 for detecting the position in the rotational direction of the cam 73. Especially in the present exemplary embodiment, the cam position sensor 78 detects a home position (HP) in the rotational direction. The cam position sensor 78 serving as a detection unit, and the detection flag 77 serving as an instruction unit that is fixed to the above-described cam shaft 74 constitute a photointerrupter 79 serving as a position detection unit.

The moving mechanism 71 can bring the orientation of the moving mechanism 71 into a preset neutral state by the action of the cam position sensor 78 and the detection flag 77.

As described above, FIGS. 4A and 4B illustrate operations of the moving mechanism 71 in a state where the intermediate transfer belt 31 is not provided. As illustrated in FIG. 4A, when the pressing member 70 is moved in a direction of pressing the intermediate transfer belt 31, the cam 73 is driven by the cam drive motor 75 to rotate clockwise. The supporting member 72 thereby pivots counterclockwise about the supporting hole 72*a*, and the position of the pressing member 70 (more specifically, leading end position) moves toward the outer circumferential surface side of the intermediate transfer belt 31. As illustrated in FIG. 4B, when the pressing member 70 is moved in a direction opposite to the above-described direction (i.e., direction of separating from the intermediate transfer belt 31), the cam 73 is driven by the cam drive motor 75 to rotate counterclockwise. The supporting member 72 thereby pivots clockwise about the supporting hole 72*a*, and the position of the pressing member 70 (more specifically, the leading end position) moves toward the inner circumferential surface side of the intermediate transfer belt 31.

Figure 5:
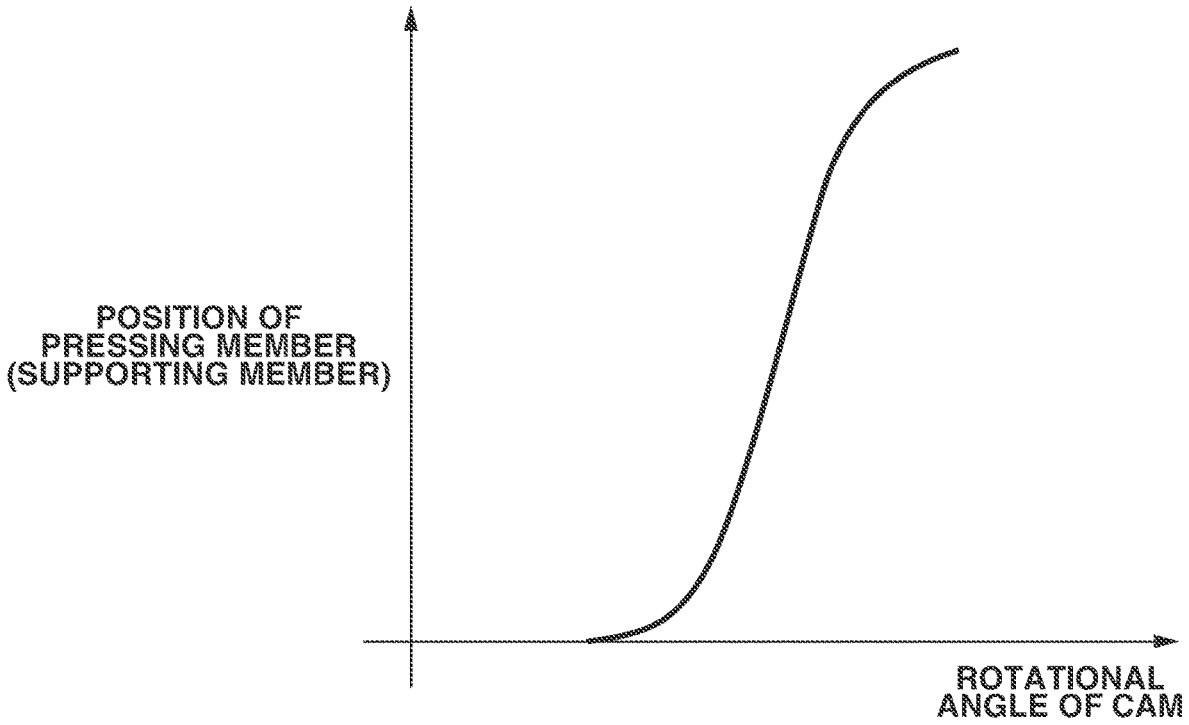
FIG. 5 is a graph schematically illustrating an example of a relationship between a rotational angle of a cam of the moving mechanism and a position of a pressing member.

In the present exemplary embodiment, the image forming apparatus 100 is configured to control the position of the pressing member 70 (more specifically, the leading end position) by controlling the position in the pivotal direction of the supporting member 72 by controlling a rotational angle of the cam 73 using a control unit 51 (FIG. 6) to be described below. In the present exemplary embodiment, the control unit 51 controls a drive amount of the cam drive motor 75 using the number of pulses input to the cam drive motor (stepping motor) 75 from the neutral state of the moving mechanism 71 (home position of the cam 73) that is detected by the cam position sensor 78. The control unit 51 can thereby control the position in the pivotal direction of the supporting member 72 by controlling the rotational angle of the cam 73. FIG. 5 illustrates a graph schematically indicating an example of a relationship between a rotational angle of the cam 73 (more specifically, the number of pulses input to the cam drive motor 75) and the position of the pressing member 70 (more specifically, a pivotal angle of the supporting member 72 from a reference position). In the present exemplary embodiment, information (table data, etc.) indicating such a relationship is prestored in a storage unit 52 to be described below. In the present exemplary embodiment, the neutral state of the moving mechanism 71 is set to a state where the pressing member 70 is separated from the intermediate transfer belt 31.

In the present exemplary embodiment, the moving mechanism 71 includes a tension spring (not illustrated), which is an urging member (elastic member) serving as an urging unit that urges the supporting member 72 to pivot in a direction for engaging the cam follower 72*b* with the cam 73. The moving mechanism 71 can thereby separate the pressing member 70 from the intermediate transfer belt 31.

4. Variation in Shape of Secondary Transfer Belt at Upstream of Secondary Transfer Portion As described above, the shape (orientation) of the intermediate transfer belt 31 at the upstream of the secondary transfer portion N2 is determined by the statically-determinate shape of the pressing member 70 when the urging force of the pressing member 70 and the drag generated by tensional force of the intermediate transfer belt 31 balance out. At this time, the pressing member 70 receives the drag generated by tensional force of the intermediate transfer belt 31, and deforms corresponding to the drag. In a case where the urging force of the pressing member 70 and the tensional force of the intermediate transfer belt 31 are nominal values, the moving mechanism 71 is only required to set the position of the pressing member 70 (more specifically, the position of the supporting member 72) to a predetermined position. The shape of the intermediate transfer belt 31 at the upstream of the secondary transfer portion N2 can be thereby set to a predetermined shape by setting a predetermined value as a pressing amount (intrusion amount to be described below) of the pressing member 70.

However, if the urging force of the pressing member 70 or the tensional force of the intermediate transfer belt 31 varies, a deformation amount of the pressing member 70 (i.e., statically-determinate shape of the pressing member 70) varies, and the shape of the intermediate transfer belt 31 at the upstream of the secondary transfer portion N2 varies as well.

In other words, if the position of the pressing member 70 is set to a predetermined position, the shape of the intermediate transfer belt 31 at the upstream of the secondary transfer portion N2 sometimes varies for each individual image forming apparatus 100, or for each replacement unit such as the intermediate transfer belt unit 30. This is because a deflection amount of the pressing member 70 varies due to variations in material characteristics (physicality) or the dimension of the pressing member 70, and the tension of the intermediate transfer belt 31. Then, if the shape (orientation) of the intermediate transfer belt 31 at the upstream of the secondary transfer portion N2 varies, a contact length between the intermediate transfer belt 31 and the recording material P at the upstream of the secondary transfer portion N2 changes from an appropriate value, and this sometimes causes the above-described image defect. Especially in a case where the recording material P with high rigidity such as thick paper or coated paper is used, an absolute value of the secondary transfer voltage is set to a relatively-large value, and the intensity of a transfer electrical field formed at the secondary transfer portion N2 tends to be large. Thus, it is demanded to accurately set a contact length between the intermediate transfer belt 31 and the recording material P at the upstream of the secondary transfer portion N2.

Figure 14A:
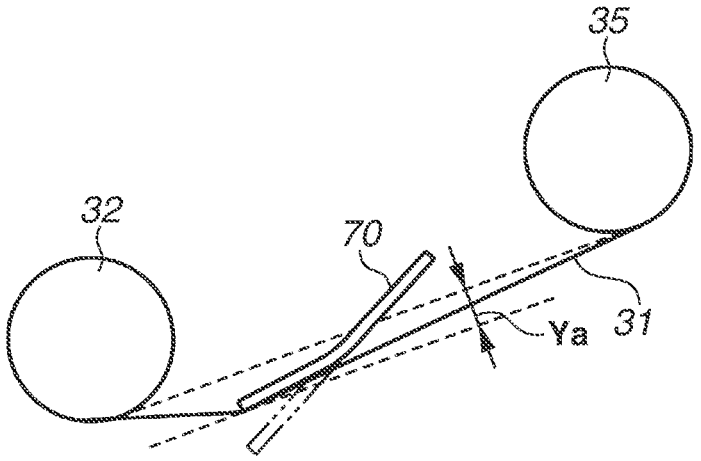
FIGS. 14A and 14B are schematic diagrams illustrating an issue of a variation in a shape of an intermediate transfer belt.
Figure 14B:
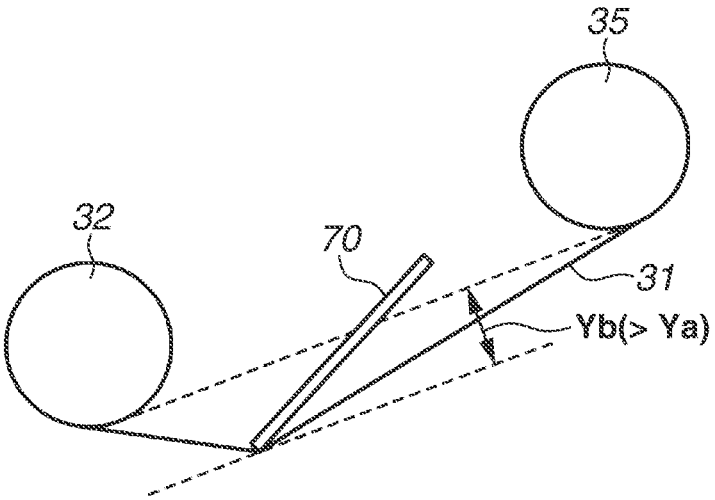

FIGS. 14A and 14B are schematic cross-sectional views illustrating a variation in the shape of the intermediate transfer belt 31 at the upstream of the secondary transfer portion N2 (cross-section substantially orthogonal to the rotational axis direction of the secondary transfer inner roller 32). FIGS. 14A and 14B exaggeratingly illustrate states in which the shape of the intermediate transfer belt 31 at the upstream of the secondary transfer portion N2 varies by a variation in a deflection amount of the pressing member 70 although the position of the pressing member 70 (more specifically, the position of the supporting member 72) is set to the same predetermined position.

For example, in a case where the urging force of the pressing member 70 is low, the drag generated by the tensional force of the intermediate transfer belt 31 becomes relatively larger. As illustrated in FIG. 14A, a deformation amount of the pressing member 70 accordingly becomes relatively larger, a deformation amount of the intermediate transfer belt 31 becomes smaller, and a pressing amount (intrusion amount to be described below) of the pressing member 70 becomes smaller. In other words, the intermediate transfer belt 31 moves away from the recording material P, and a contact length between the recording material P and the intermediate transfer belt 31 at the upstream of the secondary transfer portion N2 becomes shorter.

On the other hand, in a case where the tensional force of the intermediate transfer belt 31 is small, the urging force of the pressing member 70 becomes relatively larger. As illustrated in FIG. 14B, a deformation amount of the pressing member 70 accordingly becomes relatively smaller, a deformation amount of the intermediate transfer belt 31 becomes larger, and a pressing amount (intrusion amount to be described below) of the pressing member 70 becomes larger. The above-described pressing amount (intrusion amount to be described below) varies between the state illustrated in FIG. 14A and the state illustrated in FIG. 14B (Ya<Yb). In other words, the intermediate transfer belt 31 comes closer to the recording material P, and a contact length between the recording material P and the intermediate transfer belt 31 at the upstream of the secondary transfer portion N2 becomes longer.

In this way, if the position of the pressing member 70 is set to the predetermined position by the moving mechanism 71, a contact length between the recording material P and the intermediate transfer belt 31 at the upstream of the secondary transfer portion N2 sometimes varies. This might cause an image defect due to electric discharge caused by the above-described airspace G (FIG. 2C) becoming larger in a case where the contact length is short, or an image defect caused by the sliding friction between a toner image and the recording material P that is caused in a case where the contact length is long.

5. Pressing Amount

Figure 12A:
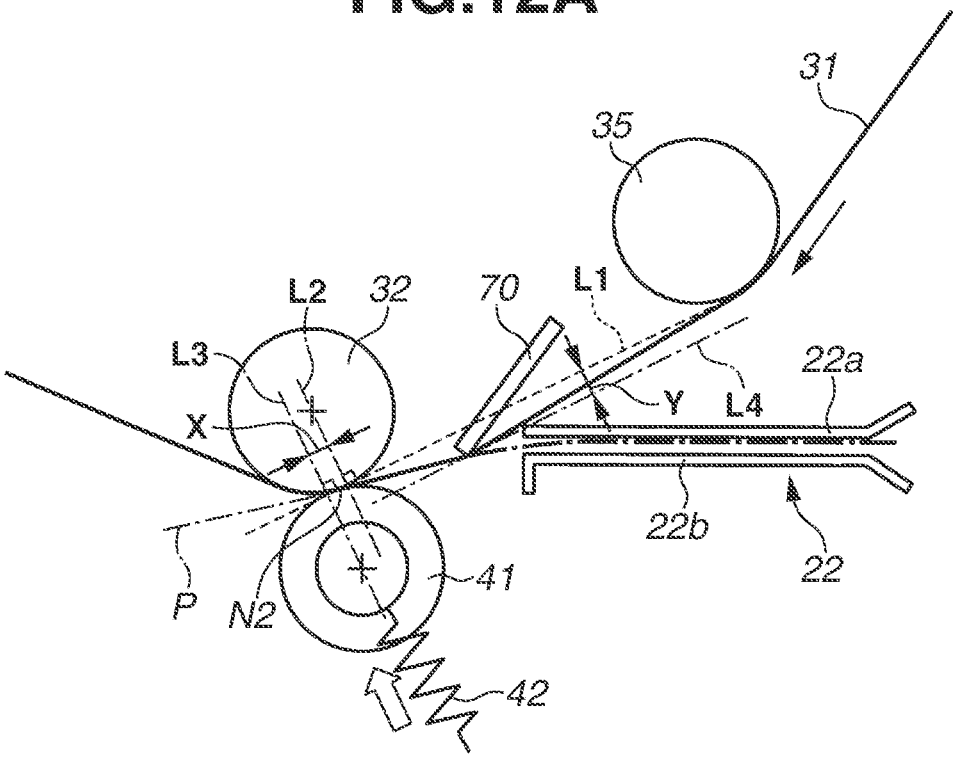
FIGS. 12A and 12B are schematic diagrams illustrating a pressing amount (intrusion amount) of a pressing member.
Figure 12B:
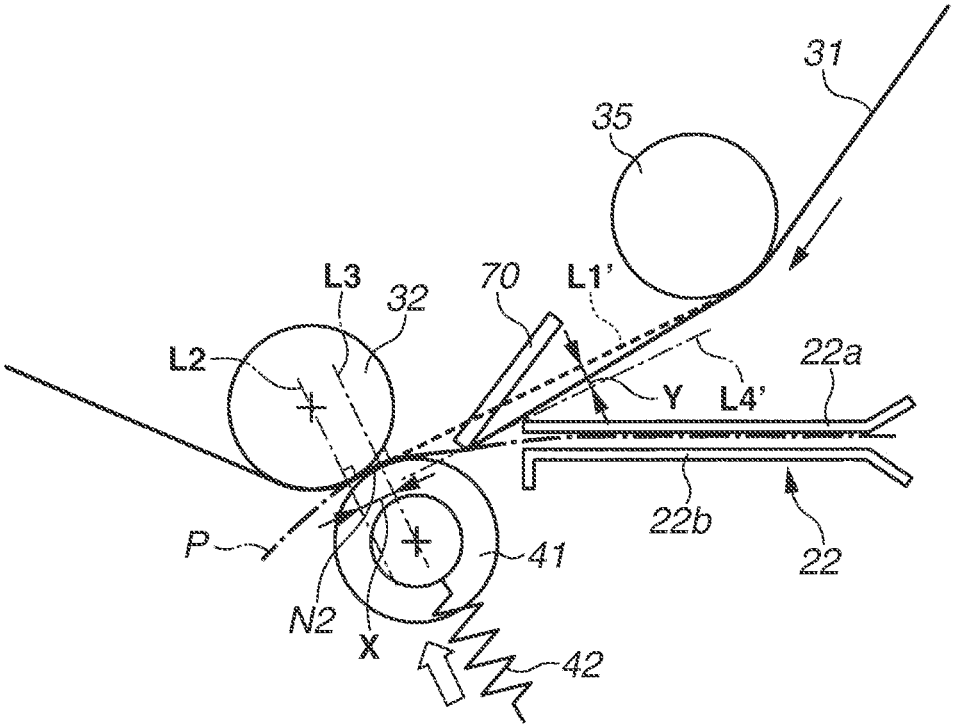

A pressing amount of the pressing member 70 will be further described. FIGS. 12A and 12B are schematic cross-sectional views of the vicinity of the secondary transfer portion N2 for describing the definition of an intrusion amount of the pressing member 70 into the intermediate transfer belt 31 (cross-section substantially orthogonal to the rotational axis direction of the secondary transfer inner roller 32).

A pressing amount of the intermediate transfer belt 31 pressed by the pressing member 70 can be represented by the following intrusion amount of the pressing member 70 into the intermediate transfer belt 31. The intrusion amount generally refers to an amount by which the pressing member 70 causes the intermediate transfer belt 31 to protrude outward from a stretched surface (tensioned surface) of the intermediate transfer belt 31 that is formed by being stretched by the secondary transfer inner roller 32 or the secondary transfer outer roller 41, and the pre-secondary transfer roller 35. The pre-secondary transfer roller 35 is an example of an upstream roller arranged adjacently to the secondary transfer inner roller 32 at the upstream of the secondary transfer inner roller 32 in the rotational direction of the intermediate transfer belt 31 among the plurality of tension rollers. More specifically, the definition of the intrusion amount varies depending on an offset amount indicating a relative position between the secondary transfer inner roller 32 and the secondary transfer outer roller 41 in the circumferential direction of the secondary transfer inner roller 32.

First, an offset amount will be described with reference to FIG. 12A. In the cross-section illustrated in FIG. 12A, a tangent line common to the secondary transfer inner roller 32 and the pre-secondary transfer roller 35 on the side on which the intermediate transfer belt 31 is stretched around is described as a reference line L1. The reference line L1 corresponds to a stretched surface of the intermediate transfer belt 31 that is formed in a case where the intermediate transfer belt 31 is not caused to protrude toward the outer circumferential surface side by the pressing member 70. In the same cross-section, a straight line passing through the rotational center of the secondary transfer inner roller 32, and being substantially orthogonal to the reference line L1 is described as an inner roller central line L2. In the same cross-section, a straight line passing through the rotational center of the secondary transfer outer roller 41, and being substantially orthogonal to the reference line L1 is described as an outer roller central line L3. At this time, a distance (vertical distance) between the inner roller central line L2 and the outer roller central line L3 is defined as an offset amount X (however, a positive value obtained when the outer roller central line L3 exists on the upstream side of the inner roller central line L2 in the rotational direction of the intermediate transfer belt 31). The offset amount X can be set to a negative value, 0, or a positive value. The offset amount X is appropriately set depending on, for example, the separability of the recording material P from the intermediate transfer belt 31.

Next, an intrusion amount will be described with reference to FIGS. 12A and 12B. The definition of the intrusion amount varies between a case where the offset amount X is a positive value, and a case where the offset amount X is 0 or a negative value. This is because whether a stretched surface of the intermediate transfer belt 31 that is formed without being pressed by the pressing member 70 is formed by the secondary transfer inner roller 32 and the pre-secondary transfer roller 35, or whether the stretched surface is formed by the secondary transfer outer roller 41 and the pre-secondary transfer roller 35 generally varies depending on the offset amount X. FIG. 12A illustrates a case where the offset amount X is 0 or a negative value (negative value in particular), and FIG. 12B illustrates a case where the offset amount X is a positive value.

First, a case where the offset amount X is 0 or a negative value will be described. In the cross-section illustrated in FIG. 12A, a tangent line common to the secondary transfer inner roller 32 and the pre-secondary transfer roller 35 on the side on which the intermediate transfer belt 31 is stretched around is described as a reference line L1. In the same cross-section, a tangent line of the intermediate transfer belt 31 that is substantially parallel to the reference line L1, and is in contact with the outer circumferential surface of the intermediate transfer belt 31 in a region in which the pressing member 70 contacts the intermediate transfer belt 31 is described as a pressing portion tangent line L4. At this time, in a case where the offset amount X is 0 or a negative value, a distance (vertical distance) between the reference line L1 and the pressing portion tangent line L4 is defined as an intrusion amount Y of the pressing member 70 into the intermediate transfer belt 31 (however, a positive value obtained when the pressing portion tangent line L4 exists closer to the outer circumferential surface of the intermediate transfer belt 31 than the reference line L1). The intrusion amount Y can be set to 0 or a positive value.

Next, a case where the offset amount X is a positive value will be described. In the cross-section illustrated in FIG. 12B, a tangent line common to the secondary transfer outer roller 41 and the pre-secondary transfer roller 35 on a side on which the intermediate transfer belt 31 is stretched around is described as a reference line L1'. In the same cross-section, a tangent line of the intermediate transfer belt 31 that is substantially parallel to the reference line L1', and is in contact with the outer circumferential surface of the intermediate transfer belt 31 in a region in which the pressing member 70 contacts the intermediate transfer belt 31 is described as a pressing portion tangent line L4'. At this time, in a case where the offset amount X is a positive value, a distance (vertical distance) between the reference line L1' and the pressing portion tangent line L4' is defined as an intrusion amount Y of the intermediate transfer belt 31 into the pressing member 70 (however, a positive value obtained when the pressing portion tangent line L4' exists closer to the outer circumferential surface of the intermediate transfer belt 31 than the reference line L1').

The intrusion amount Y can be set to 0 or a positive value.

In the present exemplary embodiment, as at least one predetermined mode, at the time of image formation (secondary transfer) in a predetermined mode in which the recording material P with high rigidity such as thick paper is used, a state in which the intermediate transfer belt 31 is pressed by the pressing member 70 (predetermined intrusion amount Y>0) is caused. Then, in the present exemplary embodiment, at the time of image formation (secondary transfer) in a mode other than the above-described predetermined mode, in which plain paper or the like is used as the recording material P, the pressing member 70 is retracted so as not to contact the intermediate transfer belt 31. In the present exemplary embodiment, the image forming apparatus 100 has a configuration in which the offset amount X is set to 0 or a negative value.

The intrusion amount Y is desirably set to about 1.0 mm to 3.5 mm or less, but the intrusion amount Y is not limited to this range. With this configuration, it is possible to stabilize the shape of the intermediate transfer belt 31 at the upstream of the secondary transfer portion N2, and reduce the possibility of disturbance of smooth rotation of the intermediate transfer belt 31 due to an excessive increase in load applied on a contact surface between the pressing member 70 and the intermediate transfer belt 31.

The pressing amount of the pressing member 70 is only required to become a predetermined value when the recording material P passes through the entry vicinity of the secondary transfer portion N2 and the secondary transfer portion N2. More specifically, the entry vicinity of the secondary transfer portion N2 is a region of the intermediate transfer belt 31 that corresponds to a region between the secondary transfer portion N2 and the position at which the pressing member 70 contacts the intermediate transfer belt 31 in the conveyance direction of the recording material P.

If the image forming apparatus 100 is left in a state in which the pressing member 70 is arranged at a position of pressing the intermediate transfer belt 31, this sometimes causes a temporal deformation of the pressing member 70. Thus, for example, in a power source OFF state or a sleep state of the image forming apparatus 100, the pressing member 70 can be arranged at a position separated from the intermediate transfer belt 31 (or a position at which the pressing member 70 merely contacts the intermediate transfer belt 31).

6. Control Configuration

The apparatus main body 110 of the image forming apparatus 100 is provided with a controller unit (control circuit) 50 (see FIG. 8A) serving as a control unit. The controller unit 50 includes a central processing unit (CPU) serving as an arithmetic control unit that is a central element that performs arithmetic processing, a storage medium such as a read-only memory (ROM), a random access memory (RAM), or a nonvolatile memory that serves as a storage unit, and an interface unit (input-output circuit).

In accordance with control programs stored in the ROM, the CPU can comprehensively control the components of the image forming apparatus 100 using the RAM as a work area, based on input signals from various sensors included in the image forming apparatus 100, and data stored in the nonvolatile memory. In the present exemplary embodiment, the controller unit 50 includes the control unit 51 and the storage unit 52 (FIG. 6) as functional blocks for setting (adjusting) the position of the pressing member 70, which will be described in detail below.

The control unit 51 is implemented by the CPU executing a program stored in the ROM, and the storage unit 52 is implemented by a storage medium such as a nonvolatile memory.

Figure 8A:
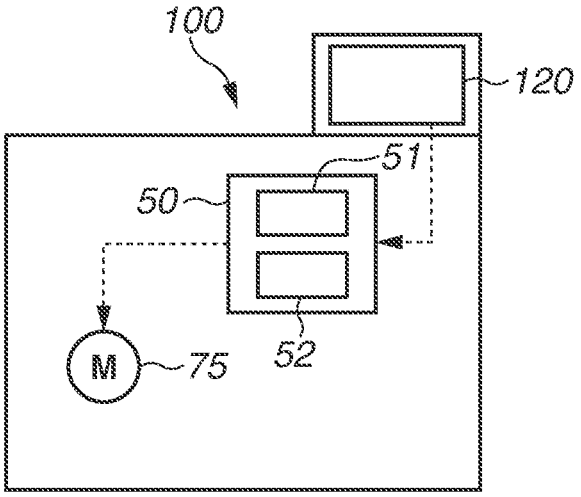
FIGS. 8A, 8B, and 8C are schematic diagrams illustrating an example of an input unit of individual difference information.

The image forming apparatus 100 is also provided with an operation unit (operation panel) 120 (see FIG. 8A). The operation unit 120 includes a display unit that displays information by the control of the controller unit 50, and an input unit that inputs information to the controller unit 50 in response to an operation performed by an operator such as a user or a service staff. The operation unit 120 may include a touch panel having functions of the display unit and the input unit. An external apparatus such as a personal computer, and an image reading device may be connected to the image forming apparatus 100.

The controller unit 50 controls each component of the image forming apparatus 100 based on information regarding a job, to execute an image forming operation. The information regarding a job is input from an external apparatus or the operation unit 120. The information regarding a job includes a start instruction (start signal), information (command signal) regarding an image forming condition such as information regarding the recording material P, and image information (image signal). The information regarding the recording material P (recording material information) encompasses arbitrary information that can identify the recording material P, such as an attribute (so-called paper type category) that is based on general features such as plain paper, high-quality paper, glazed paper, gloss paper, coated paper, embossed paper, thick paper, thin paper, and paper quality, a numerical value or a numerical value range of grammage, thickness, size, and rigidity, or brand (including manufacturer, product name, product number). The recording materials P can be classified by a type identified based on the information regarding the recording material P. The information regarding the recording material P may be included in information regarding a print mode designating an operation setting of the image forming apparatus 100, such as a "plain paper mode" and a "thick paper mode", or may be substituted by information regarding a print mode.

The image forming apparatus 100 executes a job (print job), which is a series of operations of forming images onto one or a plurality of recording materials P and outputting the recording materials P that is started in in response to one start instruction. A job generally includes an image forming process (image forming operation), a preliminary rotation process, a sheet-to-sheet interval process executed in the case of forming images onto a plurality of recording materials P, and a post rotation process. The image forming process is a period for forming an electrostatic image of an image to be output by being actually formed on the recording material P, forming a toner image, and performing primary transfer and secondary transfer of the toner image, and the image forming process (image forming period) refers to this period. More specifically, the timing of the image forming process varies depending on the positions at which these processes including the formation of an electrostatic image, the formation of a toner image, and primary transfer and secondary transfer of the toner image are performed. The preliminary rotation process is a period for performing a preparation operation prior to the image forming process, and corresponds to a period from the input of a start instruction until an image actually starts to be formed. The sheet-to-sheet interval process is a period corresponding to an interval between the recording material P and the recording material P in continuously performing image formation onto a plurality of recording materials P (continuous image formation). The post rotation process is a period for performing an arrangement operation (preparation operation) subsequent to the image forming process. A non-image forming state (non-image forming period) is a period other than the image forming period, and includes the following periods. Specifically, the non-image forming state includes a standby state, the preliminary rotation process, the sheet-to-sheet interval process, and the post rotation process, and further includes a preliminary multiple rotation process, which is a preparation operation to be performed when the power of the image forming apparatus 100 is turned on or when the image forming apparatus 100 recovers from a sleep state, and a period until the preliminary rotation process or the preliminary multiple rotation process starts from the standby state. In the present exemplary embodiment, in the non-image forming period, in the case of arranging the pressing member 70 at a position for pressing the intermediate transfer belt 31, based on a print mode to be executed thereafter, the image forming apparatus 100 performs an operation of setting (adjusting) the position of the pressing member 70.

7. Setting of Position of Pressing Member

Next, the setting (adjustment) of the position of the pressing member 70 according to the present exemplary embodiment will be described.

As described above, the formation of the shape (orientation) of the intermediate transfer belt 31 at the upstream of the secondary transfer portion N2 involves the urging force of the pressing member 70 and the tensional force of the intermediate transfer belt 31.

Thus, in the present exemplary embodiment, the image forming apparatus 100 performs the following operation in executing a predetermined mode for pressing the intermediate transfer belt 31 by the pressing member 70. More specifically, the image forming apparatus 100 sets (adjusts) the position of the pressing member 70 (specifically, the position of the supporting member 72) to an appropriate position using the moving mechanism 71 depending on an individual condition (individual difference, individual variation) for forming a predetermined shape of the intermediate transfer belt 31 at the upstream of the secondary transfer portion N2. A predetermined shape of the intermediate transfer belt 31 that has elastic reaction force can be thereby formed accurately at the upstream of the secondary transfer portion N2 by the pressing member 70 that elastically urges the inner circumferential surface of the intermediate transfer belt 31. Consequently, a contact length between the intermediate transfer belt 31 and the recording material P can be appropriately controlled. Hereinafter, more detailed description will be given.

Figure 6:
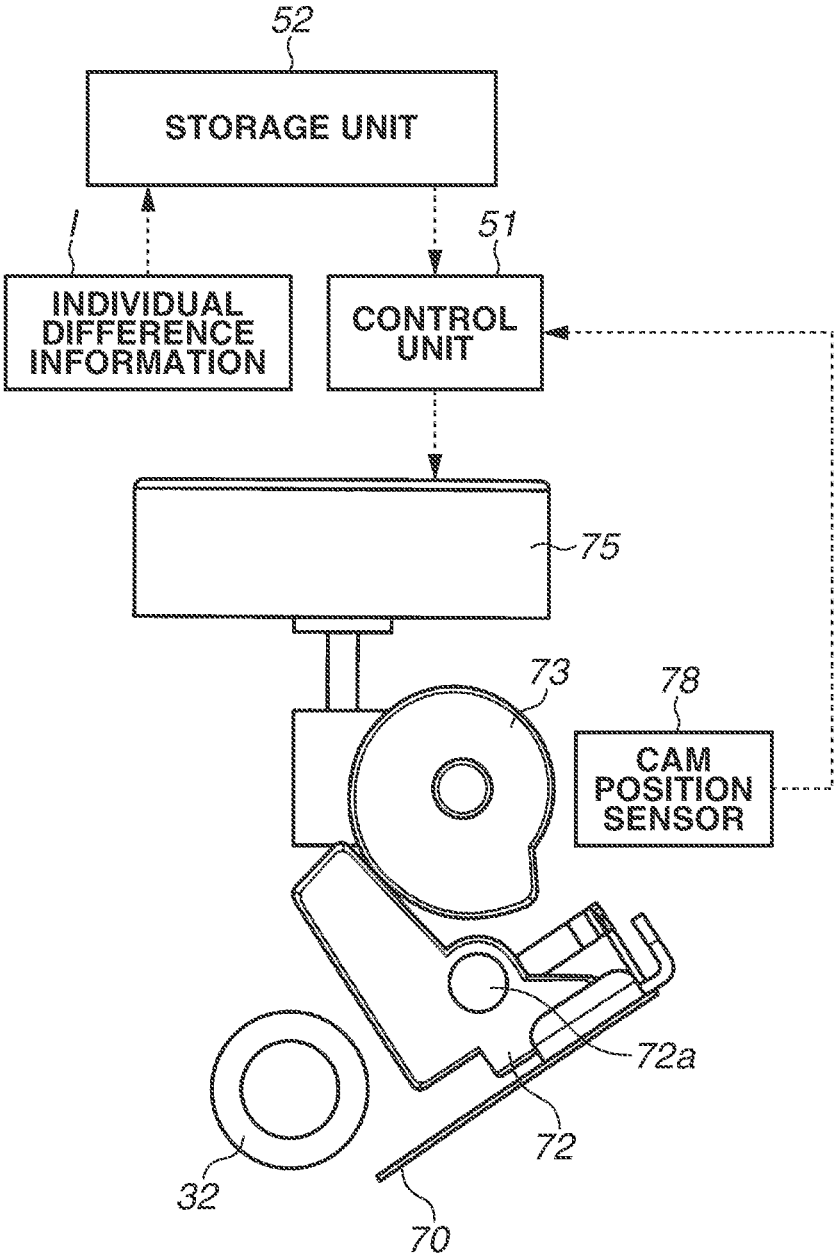
FIG. 6 is a schematic block diagram related to the setting of the position of the pressing member that is set corresponding to an individual difference.
Figure 7A:
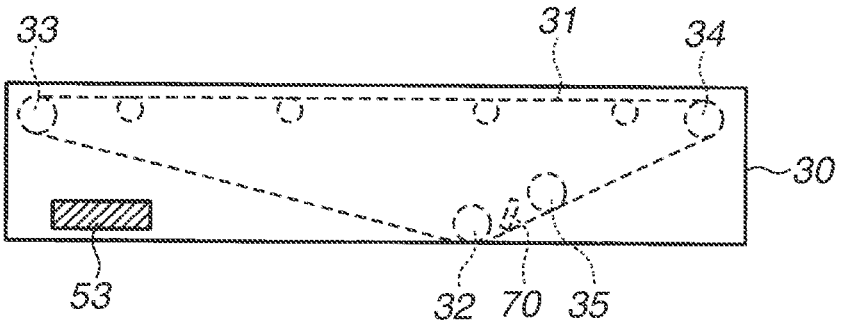
FIGS. 7A, 7B, and 7C are schematic diagrams illustrating an example of an added portion of individual difference information.
Figure 7B:
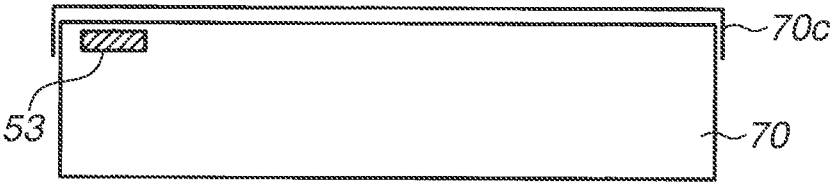
Figure 7C:
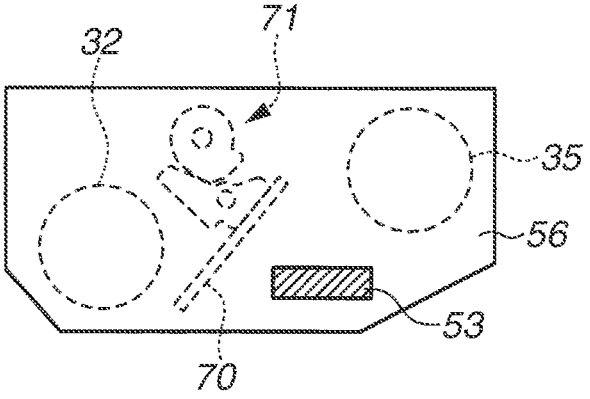
Figure 8B:
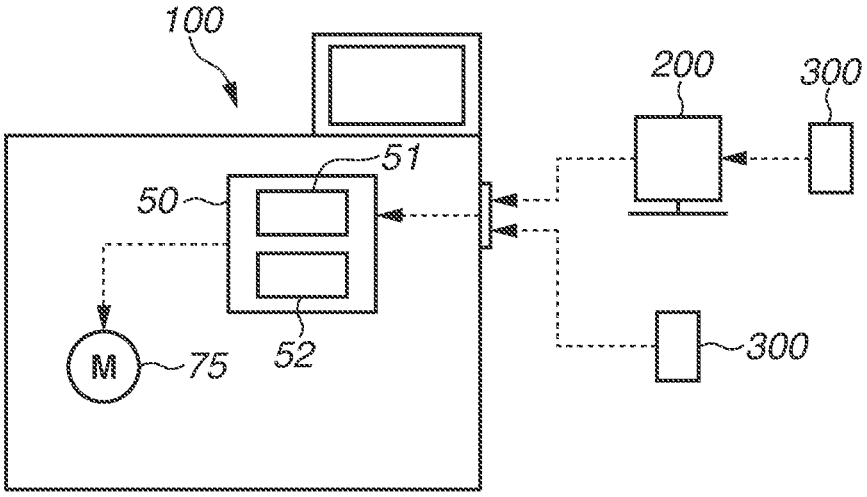
Figure 8C:
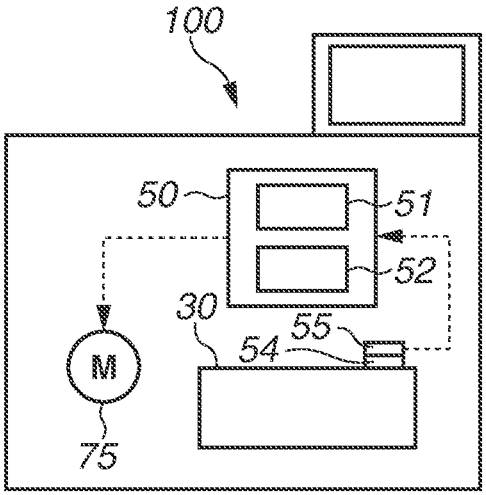

FIG. 6 is a schematic block diagram illustrating a control configuration of setting (adjusting) the position of the pressing member 70 according to the present exemplary embodiment. FIGS. 7A, 7B, and 7C are schematic diagrams illustrating an added portion of individual difference information to be described below. FIGS. 8A, 8B, and 8C are schematic diagrams illustrating an input unit of individual difference information to be described below.

In the present exemplary embodiment, the image forming apparatus 100 includes the storage unit 52 storing information (hereinafter, will also be referred to as "individual difference information") I regarding an individual difference in configuration of the image forming apparatus 100 that is related to the setting of the position of the pressing member 70 (more specifically, the position of the supporting member 72) in executing a predetermined mode.

The individual difference information I indicates an individual condition for forming the predetermined shape of the intermediate transfer belt 31 at the upstream of the secondary transfer portion N2. In the present exemplary embodiment, the individual difference information I is information regarding a characteristic value (physical property) indicating the urging force of the pressing member 70, and information regarding a characteristic value (physical property) indicating the tensional force of the intermediate transfer belt 31. The image forming apparatus 100 further includes the control unit 51 that sets the position of the pressing member 70 (more specifically, the position of the supporting member 72) in executing the predetermined mode, based on the individual difference information I. Based on the individual difference information I, the control unit 51 controls the moving mechanism 71 to move the pressing member 70 (more specifically, the supporting member 72) to an appropriate position. In the present exemplary embodiment, the above-described control unit 51 and the storage unit 52 are provided in the apparatus main body 110 (more specifically, the controller unit 50) of the image forming apparatus 100.

The description will be further given. In the present exemplary embodiment, a bending elastic coefficient of the pressing member 70 is obtained for each individual intermediate transfer belt unit 30 included in the image forming apparatus 100, as a characteristic value indicating the urging force of the pressing member 70. Furthermore, in the present exemplary embodiment, a spring constant of the tension spring 36 that adds tensional force to the intermediate transfer belt 31 via the tension roller 34 is obtained for each individual intermediate transfer belt unit 30 as a characteristic value indicating the tensional force of the intermediate transfer belt 31. Information regarding the bending elastic coefficient of the pressing member 70 and the spring constant of the tension spring 36, which serves as the individual difference information I, is added to an information-added portion provided in the intermediate transfer belt unit 30, when the intermediate transfer belt unit 30 is assembled. In the present exemplary embodiment, as illustrated in FIG. 7A, the individual difference information I is recorded in an information-described portion (sticker, etc.) 53 serving as the information-added portion that is provided at an appropriate position, and visible from the outside, such as the frame of the intermediate transfer belt unit 30. More specifically, in the present exemplary embodiment, the values of the bending elastic coefficient of the pressing member 70 and the spring constant of the tension spring 36, which serve as the individual difference information I, are described with characters in the information-described portion 53. Then, when the image forming apparatus 100 is assembled (when the intermediate transfer belt unit 30 is installed onto the apparatus main body 110 of the image forming apparatus 100) or at the time of factory shipment, the individual difference information I is input to the image forming apparatus 100 and stored into the storage unit 52. In the present exemplary embodiment, as illustrated in FIG. 8A, the individual difference information I described in the information-described portion 53 is read by an operator, and input to the control unit 51 from the operation unit 120 provided in the image forming apparatus 100 that serves as an input unit. Then, the individual difference information I is stored by the control unit 51 into the storage unit 52 (more specifically, the nonvolatile memory of the controller unit 50).

Based on the individual difference information I stored in the storage unit 52, the control unit 51 obtains an appropriate position of the pressing member 70 at which a pressing amount of the pressing member 70 becomes a predetermined pressing amount, in executing a predetermined mode. In the present exemplary embodiment, the control unit 51 applies the bending elastic coefficient of the pressing member 70 and the spring constant of the tension spring 36, which serve as the individual difference information I, to a preset calculating formula stored in the storage unit 52 (more specifically, the ROM of the controller unit 50). The control unit 51 thereby calculates the number of pulses input to the cam drive motor (stepping motor) 75 for obtaining an appropriate position of the pressing member 70 (more specifically, the position of the supporting member 72) at which the pressing amount becomes the above-described predetermined pressing amount. The above-described calculating formula is preset based on the structure of the intermediate transfer belt unit 30 in such a manner that the above-described number of input pulses can be calculated using as variables the bending elastic coefficient of the pressing member 70 and the spring constant of the tension spring 36, which serve as the individual difference information I. In the present exemplary embodiment, the above-described number of input pulses is the number of pulses input to the cam drive motor 75 from the neutral state of the moving mechanism 71 that is detected by the cam position sensor 78. Then, in executing the predetermined mode, the control unit 51 inputs the above-described calculated number of pulses to the cam drive motor 75 from the neutral state of the moving mechanism 71 that is detected by the cam position sensor 78, and moves the pressing member 70.

In this way, in the present exemplary embodiment, the moving mechanism 71 performs variable control of the position of the pressing member 70 depending on an individual difference. An appropriate shape of the intermediate transfer belt 31 at the upstream of the secondary transfer portion N2 can be thereby obtained by setting a pressing amount of the pressing member 70 to an appropriate value based on an individual difference.

Figure 9A:
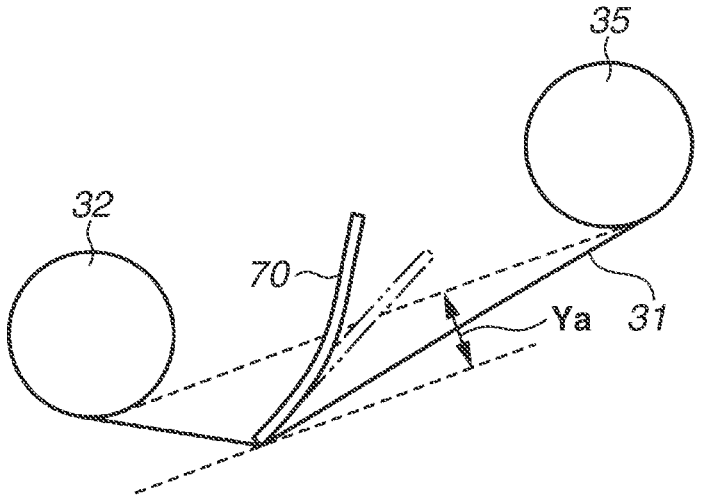
FIGS. 9A and 9B are schematic diagrams illustrating an effect of setting the position of the pressing member corresponding to an individual difference.
Figure 9B:
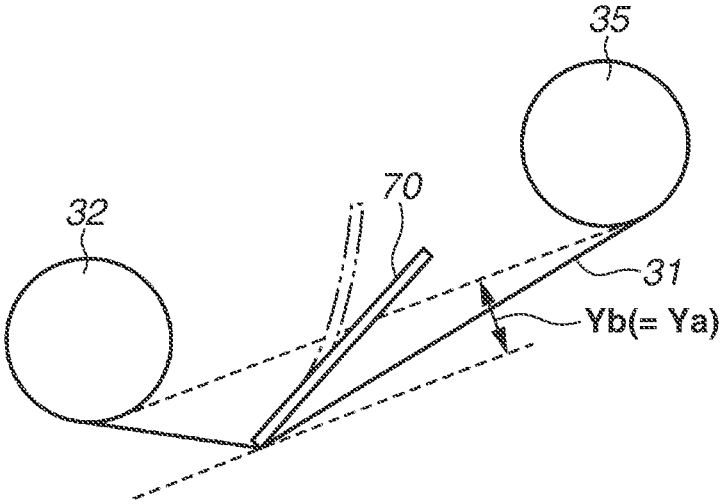

FIGS. 9A and 9B are schematic cross-sectional views of the vicinity of the pressing member 70 illustrating an effect of setting the position of the pressing member 70 corresponding to an individual difference according to the present exemplary embodiment (cross-section substantially orthogonal to the rotational axis direction of the secondary transfer inner roller 32). FIGS. 9A and 9B exaggeratingly illustrate a state in which the position of the pressing member 70 (more specifically, the position of the supporting member 72) is adjusted based on the individual difference information I in a case where the urging force of the pressing member 70 or the tensional force of the intermediate transfer belt 31 varies.

For example, in a case where the urging force of the pressing member 70 is relatively low and the drag generated by the tensional force of the intermediate transfer belt 31 is relatively large, a moving amount of the pressing member 70 in a direction of pressing the intermediate transfer belt 31, from the neutral state of the moving mechanism 71 becomes relatively larger. With this configuration, as illustrated in FIG. 9A, an appropriate pressing amount (intrusion amount Y) of the pressing member 70 can be obtained in a state in which a deformation amount of the pressing member 70 is relatively large. Consequently, an appropriate shape of the intermediate transfer belt 31 at the upstream of the secondary transfer portion N2 can be obtained, and an appropriate contact length between the intermediate transfer belt 31 and the recording material P can be obtained.

In a case where the urging force of the pressing member 70 is relatively large and the tensional force of the intermediate transfer belt 31 is relatively small, a moving amount of the pressing member 70 in a direction of pressing the intermediate transfer belt 31, from the neutral state of the moving mechanism 71 becomes relatively smaller. With this configuration, as illustrated in FIG. 9B, an appropriate pressing amount (intrusion amount Y) of the pressing member 70 can be obtained in a state in which a deformation amount of the pressing member 70 is relatively small. Consequently, an appropriate shape of the intermediate transfer belt 31 at the upstream of the secondary transfer portion N2 can be obtained, and an appropriate contact length between the intermediate transfer belt 31 and the recording material P can be obtained. The above-described pressing amount (intrusion amount Y) becomes substantially the same in the case illustrated in FIG. 9A and the case illustrated in FIG. 9B (Ya=Yb).

In this way, according to the present exemplary embodiment, it is possible to suppress a variation in the contact length between the recording material P and the intermediate transfer belt 31 at the upstream of the secondary transfer portion N2, caused by an individual difference. With this configuration, it is possible to prevent the occurrence of an image defect due to electric discharge caused by the above-described airspace G (FIG. 2C) becoming larger in a case where the contact length is short, and an image defect due to sliding friction between a toner image and the recording material P that is caused in a case where the contact length is long.

Figure 10:
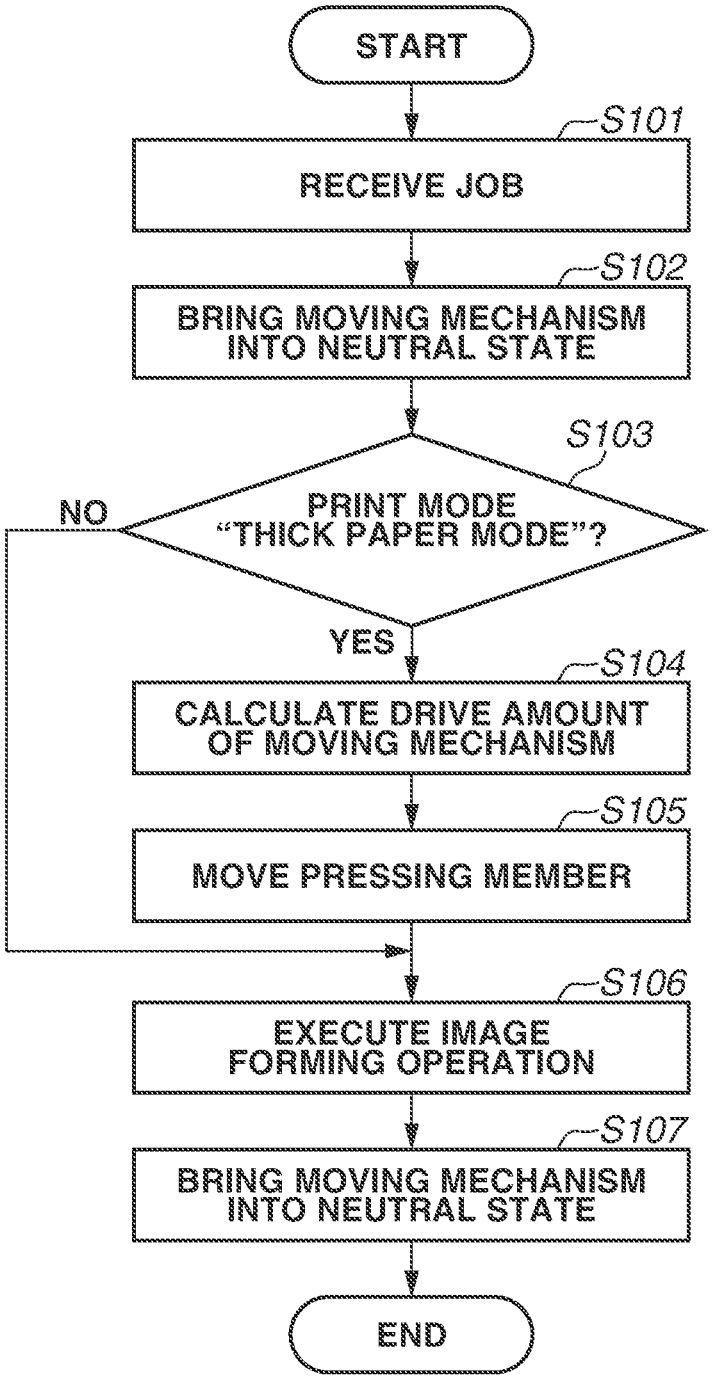
FIG. 10 is a flowchart illustrating an example of an operation of a job.

FIG. 10 is a flowchart illustrating an example of an operation of a job including an operation of setting the position of the pressing member 70. In this example, a predetermined mode is set to the "thick paper mode" in which thick paper is designated as the recording material P, and the intermediate transfer belt 31 is pressed by the pressing member 70 (predetermined intrusion amount Y>0). For the sake of simplicity, a case where an image is formed onto one recording material P will be described.

In step S101, the control unit 51 receives information regarding a job that has been input from an external apparatus such as a personal computer. In step S102, the control unit 51 controls the moving mechanism 71 in such a manner that the neutral state of the moving mechanism 71 is detected by the cam position sensor 78. At this time, in a case where the moving mechanism 71 is already in the neutral state, the control unit 51 maintains the state, and in a case where the moving mechanism 71 is not in the neutral state, the control unit 51 drives the cam drive motor 75 so as to bring the moving mechanism 71 into the neutral state. In the present exemplary embodiment, in the neutral state of the moving mechanism 71, the pressing member 70 is separated from the intermediate transfer belt 31. Next, in step S103, the control unit 51 determines whether a print mode is the "thick paper mode", based on the information regarding the job. In a case where the control unit 51 determines in step S103 that the print mode is the "thick paper mode" (YES in step S103), the processing proceeds to step S104 in which processing of moving the pressing member 70 to a position for pressing the intermediate transfer belt 31 is performed. More specifically, in step S104, the control unit 51 calculates the number of pulses input to the cam drive motor 75 for obtaining an appropriate position of the pressing member 70 (more specifically, the position of the supporting member 72) at which a pressing amount becomes a predetermined pressing amount in the "thick paper mode", based on the individual difference information I stored in the storage unit 52. Then, in step S105, the control unit 51 inputs the above-described calculated number of pulses to the cam drive motor 75, and moves the pressing member 70. After that, in step S106, the control unit 51 executes an image forming operation in the "thick paper mode" as soon as a predetermined preliminary rotation operation ends. If the image forming operation ends, in step S107, the control unit 51 brings the moving mechanism 71 into the neutral state as soon as a predetermined post rotation operation ends, and brings the image forming apparatus 100 into a standby state. In a case where the control unit 51 determines in step S103 that the print mode is not the "thick paper mode" (NO in step S103), the processing proceeds to step S106, in which the control unit 51 controls an image forming operation to be executed while maintaining the moving mechanism 71 in the neutral state. In a job of continuous image formation onto a plurality of recording materials P, in a case where the type of the recording material P is changed during the job, an operation of changing the position of the pressing member 70 can be performed between sheets.

Figure 11A:
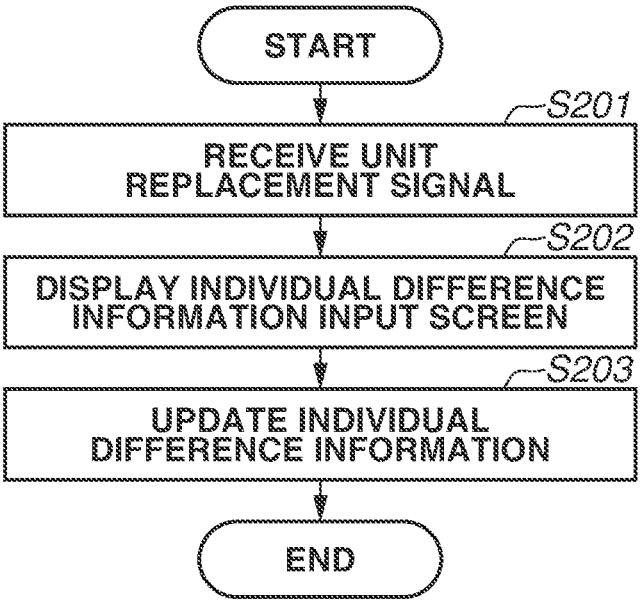
FIG. 11A is a flowchart illustrating an example of processing to be performed when a unit is replaced.
Figure 11B:
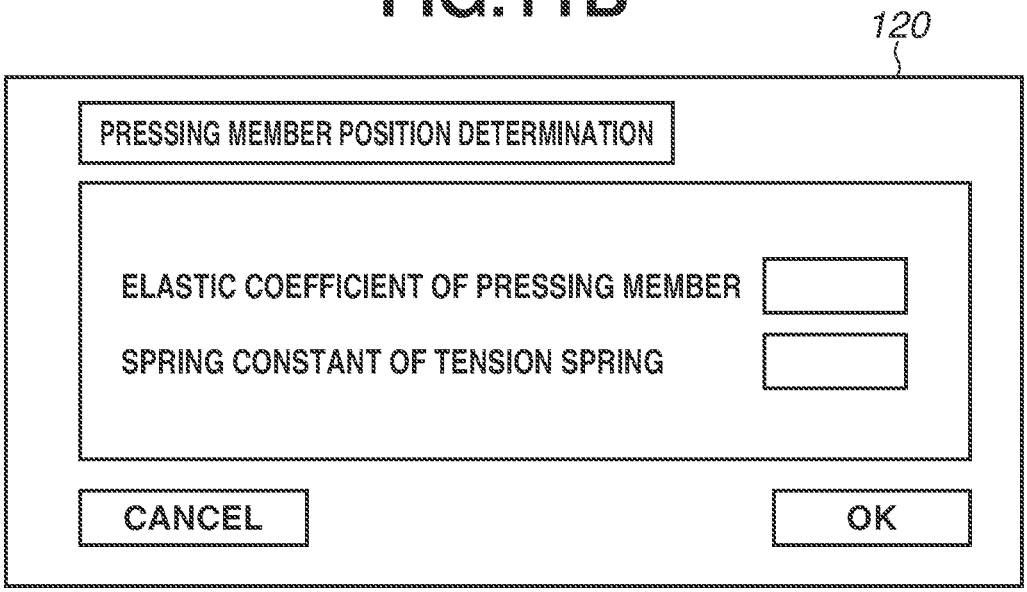
FIG. 11B is a schematic diagram of an input screen for individual difference information.

FIG. 11A is a flowchart illustrating an example of an input operation of the individual difference information I performed when a replacement unit is replaced. FIG. 11B is a schematic diagram of an input screen of the individual difference information I. An operation to be performed when the intermediate transfer belt unit 30 serving as a replacement unit including the pressing member 70 and the intermediate transfer belt 31 is replaced will be described as an example.

The pressing member 70 and the intermediate transfer belt 31 sometimes deteriorate by ablation along with the use of the image forming apparatus 100. Thus, operating lives of the pressing member 70 and the intermediate transfer belt 31 in the intermediate transfer belt unit 30 are sometimes set to a shorter life as compared with the operating life of the apparatus main body 110 of the image forming apparatus 100. Then, for example, in a case where an accumulated value of an index value (e.g., rotational distance, the number of rotations, rotation time, bias application time, etc.) having correlation with a used amount of the intermediate transfer belt 31 reaches a predetermined threshold value, the entire intermediate transfer belt unit 30 is replaced with new one.

As noted above, an intermediate transfer belt unit 30 serving as a belt conveyance device includes the intermediate transfer belt 31, the tension rollers 32 to 35, the primary transfer rollers 15, the belt cleaning device 37, and a frame (not illustrated) supporting these components. The individual difference information I indicates an individual condition for forming the predetermined shape of the intermediate transfer belt 31 at the upstream of the secondary transfer portion N2 (FIG. 1 and FIG. 12B). In a case where a first intermediate transfer belt unit 30 having a first intermediate transfer belt 31 is replaced with a second intermediate transfer belt unit 30 having a second intermediate transfer belt 31, in step S201, information indicating that the replacement of the first intermediate transfer belt unit 30 has been performed is received from input by an operator to the control unit 51 via the operation unit 120 (FIG. 8A). Upon receiving the replacement performed information, in step S202, the control unit 51 displays an input screen on the operation unit 120 for inputting pressing member position determination information regarding the second intermediate transfer belt unit 30. As illustrated in FIG. 11B, for example, the input screen includes data input boxes to receive the bending elastic coefficient of the pressing member 70 and the spring constant of the tension spring 36, which serve as the individual difference information I of the second intermediate transfer belt 31. The operator inputs, into the input screen displayed on the operation unit 120, the bending elastic coefficient of the pressing member 70 and the spring constant of the tension spring 36 as the individual difference information I read from the information-described portion 53 (FIG. 7A) provided in the second intermediate transfer belt unit 30. In step S203, the control unit 51 acquires the bending elastic coefficient of the pressing member 70 and the spring constant of the tension spring 36, which serve as the individual difference information I input into the input screen on the operation unit 120, and rewrites the existing individual difference information I related to the first intermediate transfer belt 31 and stored in the storage unit 52, with the individual difference information I related to the second intermediate transfer belt 31 acquired in step S203. In other words, the control unit 51 performs processing of updating information stored in the storage unit 52, with information corresponding to the second intermediate transfer belt unit 30 after the replacement from the information corresponding to the first intermediate transfer belt unit 30 that resided in place before being replaced.

In the present exemplary embodiment, information to be input from the operation unit 120 when the image forming apparatus 100 is assembled or when a replacement unit is replaced may be input from an external apparatus communicably connected to the image forming apparatus 100.

As described above, according to the present exemplary embodiment, it is possible to prevent an image defect due to a variation in the shape of the intermediate transfer belt 31 at the upstream of the secondary transfer portion N2 for each individual image forming apparatus 100, or in replacement unit such as the intermediate transfer belt unit 30.

Next, a second exemplary embodiment of the present disclosure will be described. A basic configuration and operations of an image forming apparatus according to the present exemplary embodiment are the same as those of the image forming apparatus according to the first exemplary embodiment. Thus, in the image forming apparatus according to the present exemplary embodiment, the components having functions or configurations the same as or corresponding to those of the image forming apparatus according to the first exemplary embodiment are assigned the same reference numerals as those in the first exemplary embodiment, and detailed descriptions thereof will be omitted. In the present exemplary embodiment, various modified examples of the configuration of the first exemplary embodiment will be described.

In the first exemplary embodiment, the values of the bending elastic coefficient of the pressing member 70 and the spring constant of the tension spring 36, which serve as the individual difference information I, are described with characters in the information-described portion 53 (FIG. 7A) serving as an information-added portion, but the present disclosure is not limited to this configuration. The individual difference information I can be recorded by an arbitrary recordable method. For example, information regarding the bending elastic coefficient of the pressing member 70 and the spring constant of the tension spring 36, which serve as the individual difference information I, can be recorded in the information-described portion 53 as a two-dimensional code, which is an example of a readable code. The readable code is not limited to a two-dimensional code. In this example, the description will be given assuming that a two-dimensional code is used. In this case, for example, as illustrated in FIG. 8B, when the image forming apparatus 100 is assembled (when the intermediate transfer belt unit 30 is installed onto the apparatus main body 110 of the image forming apparatus 100) or at the time of factory shipment, a two-dimensional code described in the information-described portion 53 is read by a two-dimensional code reader 300. Then, the individual difference information I indicated by the read two-dimensional code is input to the image forming apparatus 100, and stored into the storage unit 52. At this time, the read information can be input to the image forming apparatus 100 from the two-dimensional code reader 300 directly communicably connected via an interface 130 (may be wired or wireless) serving as an input unit. Alternatively, the information read by the two-dimensional code reader 300 may be input to the image forming apparatus 100 via an external apparatus 200 communicably connected to the image forming apparatus 100 via the interface 130. In both cases, the control unit 51 of the image forming apparatus 100 may control writing of information into the storage unit 52. The two-dimensional code may be a code complying with an arbitrary known available standard. Hardware and software included in the two-dimensional code reader 300 may have a configuration of an arbitrary known configuration complying with the standard.

By using a two-dimensional code in this manner, it is possible to simplify a setting operation performed at the time of the production or factory shipment of the image forming apparatus 100. Both the individual difference information I written with characters and the individual difference information I indicated by a two-dimensional code may be described in the information-described portion 53. With this configuration, a two-dimensional code can be used when the intermediate transfer belt unit 30 is installed onto the image forming apparatus 100 before shipment, and characters can be used when the intermediate transfer belt unit 30 is attached to the image forming apparatus 100 as a replacement unit after shipment. A two-dimensional code may be described in the information-described portion 53 of the intermediate transfer belt unit 30 to be installed onto the image forming apparatus 100 before shipment, and characters may be described in the information-described portion 53 of the intermediate transfer belt unit 30 to be shipped as a replacement unit.

In the first exemplary embodiment, the individual difference information I is obtained for each individual intermediate transfer belt unit 30, and recorded for each individual intermediate transfer belt unit 30, but the present disclosure is not limited to this configuration. The individual difference information I may be obtained for each arbitrary configuration unit of the image forming apparatus 100 that is related to the setting of the position of the pressing member 70 in executing a predetermined mode, and may be recorded for each configuration unit. The configuration unit may be, for example, a unit integrally installed onto the image forming apparatus 100, or may be a replacement unit or an attachable unit to be integrally attached or detached. For example, as illustrated in FIG. 7B, in the intermediate transfer belt unit 30, the pressing member 70 (may be integrated with the attaching portion 70*c*) is sometimes further formed as an interchangeable replacement unit (pressing member unit). As illustrated in FIG. 7C, in the intermediate transfer belt unit 30, the pressing member 70 is sometimes further formed as an interchangeable replacement unit (inner roller unit 56) together with other members such as the secondary transfer inner roller 32, the moving mechanism 71, and the pre-secondary transfer roller 35. In this case, as illustrated in FIGS. 7B and 7C, the individual difference information I regarding the urging force of the pressing member 70 may be described in the information-described portion 53 provided in these replacement units. Also in this case, the individual difference information I regarding the tensional force of the intermediate transfer belt 31 may be described in the information-described portion 53 provided on the frame of the intermediate transfer belt unit 30. Also in a case where the units as illustrated in FIGS. 7B and 7C are directly installed onto the apparatus main body 110 of the image forming apparatus 100, or formed to be interchangeable, the individual difference information I can be illustrated similarly in FIGS. 7B and 7C.

In addition, an information-added portion is not limited to the information-described portion (sticker, etc.) 53 in which a character or a code is described. The information-added portion is only required to be a unit to which the individual difference information I can be added (recorded). For example, the information-added portion may be a storage medium such as a memory (nonvolatile memory, etc.) that can store information. In this case, for example, as illustrated in FIG. 8C, when the intermediate transfer belt unit 30 is assembled, the individual difference information I is stored into a memory 54 provided in the intermediate transfer belt unit 30. Then, when the image forming apparatus 100 is assembled, at the time of factory shipment, or when the intermediate transfer belt unit 30 is replaced, the individual difference information I is read from the above-described memory 54 by the control unit 51 via a reading unit 55 serving as an input unit that is provided in the image forming apparatus 100. Then, the individual difference information I is stored by the control unit 51 into the storage unit 52. The individual difference information I read from the memory 54 by a reading unit provided on the outside of the image forming apparatus 100 may be input to the image forming apparatus 100 directly or via an external apparatus, and stored into the storage unit 52. Alternatively, the individual difference information I may be directly input to the image forming apparatus 100 and stored into the storage unit 52 not via an information-added portion provided in the intermediate transfer belt unit 30. For example, the individual difference information I (character or two-dimensional code) may be described on a recording medium such as a sheet to be delivered (typically, enclosed) in association with the intermediate transfer belt unit 30 in which an information-added portion is assumed to be provided in the above description.

In the first exemplary embodiment, the storage unit 52 and the control unit 51 are provided in the apparatus main body 110 of the image forming apparatus 100, but the present disclosure is not limited to this configuration. The storage unit 52 and the control unit 51 may be provided in any point in the image forming apparatus 100 as long as the setting of the position of the pressing member 70 as described in the first exemplary embodiment can be performed. For example, at least one of the storage unit 52 or the control unit 51 may be provided in the intermediate transfer belt unit 30. In addition, at least one of the storage unit 52 or the control unit 51 may be provided in another unit in the image forming apparatus 100 such as a fixing unit.

In the first exemplary embodiment, as the individual difference information I indicating an individual condition for forming a predetermined shape of the intermediate transfer belt 31 at the upstream of the secondary transfer portion N2, information regarding a characteristic value indicating the urging force of the pressing member 70, and information regarding a characteristic value indicating the tensional force of the intermediate transfer belt 31 are both used. However, the present disclosure is not limited to this configuration. As the individual difference information I, at least one of information regarding a characteristic value indicating the urging force of the pressing member 70, or information regarding a characteristic value indicating the tensional force of the intermediate transfer belt 31 can be used. As the individual difference information I, together with at least one of information regarding a characteristic value indicating the urging force of the pressing member 70, and information regarding a characteristic value indicating the tensional force of the intermediate transfer belt 31, or in place of at least one of these, another type of information indicating an individual condition for forming a predetermined shape of the intermediate transfer belt 31 at the upstream of the secondary transfer portion N2 may be used.

In the first exemplary embodiment, information regarding an elastic coefficient of the pressing member 70 is used as information regarding the urging force of the pressing member 70. However, the present disclosure is not limited to this configuration, and any information regarding the urging force of the pressing member 70 can be used. Examples of the information regarding the urging force of the pressing member 70 include information such as material characteristics (physical characteristics such as elastic coefficient or expansion coefficient) or a dimension (thickness, length in longitudinal direction, width in transverse direction, etc.) of the pressing member 70, the position of the pressing member 70 (more specifically, the leading end position) in a case where the supporting member 72 is at a predetermined position, the position of the supporting member 72 in a case where predetermined urging force of the pressing member 70 is obtained, and a relationship between the position of the pressing member 70 and a moving amount of the supporting member 72 (rotational angle of cam 73). A value obtained by actually measuring urging force corresponding to the position of the pressing member 70 can also be used as information regarding the urging force of the pressing member 70. For example, a position for obtaining predetermined urging force of the pressing member 70 may be obtained by measurement, information regarding a rotational angle of the cam 73 for obtaining the position (i.e., information regarding the number of pulses input to the cam drive motor 75) may be obtained by measurement, and the information regarding the rotational angle may be used as the individual difference information I. In the case of the configuration of elastically urging an intermediate transfer belt using a pressing member with relatively-high rigidity by urging the pressing member by an urging member, the urging force of the urging member can be regarded as the urging force of the pressing member.

In the first exemplary embodiment, information regarding a spring constant of the tension spring 36 serving as a tensional force adding unit that adds tensional force to the intermediate transfer belt 31 is used as information regarding the tensional force of the intermediate transfer belt 31. However, the present disclosure is not limited to this configuration, and any information regarding the tensional force of the intermediate transfer belt 31 can be used. Examples of the information regarding the tensional force of the intermediate transfer belt 31 include information such as material characteristics (physical characteristics such as elastic coefficient or expansion coefficient) or a dimension (circumferential length, thickness, width, etc.) of the intermediate transfer belt 31, material characteristics (physical characteristics such as elastic coefficient or expansion coefficient), a position (position in a circumferential direction or a radial direction of the intermediate transfer belt 31), or a dimension (length in the rotational axis direction, diameter, etc.) of at least one tension roller of a plurality of tension rollers of the intermediate transfer belt 31.

In the first exemplary embodiment, based on the individual difference information I stored in the storage unit 52, the control unit 51 obtains, by calculation, the position of the pressing member 70 in executing a predetermined mode, but the present disclosure is not limited to this configuration. A table data for obtaining the position of the pressing member 70 that corresponds to the individual difference information I may be created in advance.

In the first exemplary embodiment, in executing a predetermined mode, the position of the pressing member 70 is obtained based on information regarding the urging force of the pressing member 70, and information regarding the tensional force of the intermediate transfer belt 31 that are stored in the storage unit 52. However, the present disclosure is not limited to this configuration. For example, information regarding the position of the pressing member 70 that has been obtained based on information regarding the urging force of the pressing member 70, and information regarding the tensional force of the intermediate transfer belt 31 may be stored in the storage unit 52 as the individual difference information I. Specifically, the information regarding the position of the pressing member 70 may be information regarding the number of pulses input to the cam drive motor 75 for determining the position of the supporting member 72. In addition, the information regarding the position of the pressing member 70 may be obtained by the control unit 51 of the image forming apparatus 100 when the image forming apparatus 100 is assembled or when a replacement unit is replaced, or information obtained by an external apparatus may be input to the image forming apparatus 100. Information regarding the urging force of the pressing member 70 and information regarding the tensional force of the intermediate transfer belt 31, and information regarding the position of the pressing member 70 that has been obtained based these pieces of information may be all stored in the storage unit 52.

Other than information directly indicating information regarding the urging force of the pressing member 70 and information regarding the tensional force of the intermediate transfer belt 31, the individual difference information I may be identification information designating the information. For example, based on identification information serving as the individual difference information I, the control unit 51 may acquire information regarding the urging force of the pressing member 70 and information regarding the tensional force of the intermediate transfer belt 31 that correspond to the identification information, from a storage unit of an external apparatus such as a server that is communicably connected to the image forming apparatus 100.

In the first exemplary embodiment, in executing a predetermined mode in which the recording material P with high rigidity such as thick paper or coated paper is used, the pressing member 70 and the intermediate transfer belt 31 are brought into contact, and in executing another mode, the pressing member 70 is retracted so as not to contact the intermediate transfer belt 31. However, the present disclosure is not limited to this configuration. For example, at least at the time of image formation (secondary transfer), the pressing member 70 and the intermediate transfer belt 31 may be always brought into contact irrespective of the type of the recording material P. The image forming apparatus 100 may be able to execute a plurality of modes in which the pressing member 70 and the intermediate transfer belt 31 are brought into contact. At this time, in part or all of the plurality of modes, a predetermined pressing amount (intrusion amount) of the pressing member 70 may differ. In this case, the position of the pressing member 70 can be set, similar to the first exemplary embodiment, in such a manner that a predetermined pressing amount (intrusion amount) of the pressing member 70 in each mode can be obtained. The position of the pressing member 70 in at least one predetermined mode of a plurality of modes may be set similarly to the first exemplary embodiment, and the position of the pressing member 70 in other modes may be set based on the position in the predetermined mode as a reference. More specifically, by adding or subtracting a predetermined value to or from the number of pulses to be input to the cam drive motor 75 in the reference predetermined mode, the number of pulses to be input to the cam drive motor 75 in other modes can be obtained.

In the first exemplary embodiment, the moving mechanism 71 is configured to cause the pressing member 70 to pivot, but the present disclosure is not limited to this configuration. The moving mechanism 71 is only required to include a moving unit movable so as to move the pressing member 70 in a direction for pressing the intermediate transfer belt 31, and a direction opposite to the direction. For example, the moving mechanism 71 may be configured to be capable of changing the position of the pressing member 70 (more specifically, the leading end position) by linearly reciprocating (sliding) the pressing member 70.

In the first exemplary embodiment, an actuator actuating a moving unit using a cam is used as the moving mechanism 71, but the moving mechanism 71 is not limited to this. The moving mechanism 71 is only required to implement an operation according to the first exemplary embodiment, and an actuator actuating a moving unit using a solenoid may be used, for example.

[Others]

Heretofore, specific exemplary embodiments of the present disclosure have been described, but the present disclosure is not limited to the above-described exemplary embodiments.

In the above-described exemplary embodiments, an outer roller that is in direct contact with the outer circumferential surface of an intermediate transfer belt is used as an outer member that forms a secondary transfer portion together with an inner roller serving as an inner member. On the other hand, a secondary transfer belt stretched around an outer roller and a roller different from the outer roller may be used as an outer member. Then, the outer roller can contact the outer circumferential surface of the intermediate transfer belt via the secondary transfer belt. In this configuration, by nipping the intermediate transfer belt and the secondary transfer belt between an inner roller that contacts the inner circumferential surface of the intermediate transfer belt, and the outer roller that contacts the inner circumferential surface of the secondary transfer belt, a secondary transfer portion is formed. In this case, a contact portion between the intermediate transfer belt and the secondary transfer belt corresponds to the secondary transfer portion (secondary transfer nip).

In the above-described exemplary embodiments, the description has been given of a case where a belt-like image bearing member serves as an intermediate transfer belt, but the present disclosure can be applied to an image bearing member as long as the image bearing member is formed by an endless belt that bears and conveys a toner image formed at an image forming position. As such a belt-like image bearing member, a photosensitive member belt or an electrostatic recording dielectric belt can be exemplified in addition to the intermediate transfer belt in the above-described exemplary embodiments.

The present disclosure can be also implemented as another exemplary embodiment in which a part or all of the configurations in the above-described exemplary embodiments are replaced with alternative configurations. Thus, the present disclosure can be applied to an image forming apparatus that uses a belt-like image bearing member irrespective of a tandem-type/one-drum type, a charging method, an electrostatic image formation method, a development method, a transfer method, and a fixing method. In the above-described exemplary embodiments, a main part related to the formation/transfer of a toner image has been mainly described, but the present disclosure can be applied to various intended uses such as a printer, various printing machines, a copying machine, a facsimile machine, and a multifunction peripheral by adding necessary devices, equipment, and a casing structure.

According to an exemplary embodiment of the present disclosure, it is possible to prevent an image defect caused by a variation in the shape of a belt at the upstream of a transfer portion in a rotational direction of the belt.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-210845, filed Dec. 18, 2020, which is hereby incorporated by reference herein in its entirety.

What is claimed is:

1. An image forming apparatus comprising:

a belt that is rotatable and endless, and configured to bear a toner image;

a plurality of tension rollers including an inner roller and an upstream roller arranged adjacently to the inner roller at an upstream of the inner roller in a rotational direction of the belt, wherein the plurality of tension rollers is configured to stretch the belt around the inner roller and the upstream roller;

an outer member arranged to face the inner roller via the belt and configured to form a transfer portion at which the toner image is transferred from the belt onto a recording material, in cooperation with the inner roller;

a pressing member configured to contact an inner circumferential surface of the belt at the upstream of the inner roller and a downstream of the upstream roller in the rotational direction of the belt, and press the inner circumferential surface of the belt toward an outer circumferential surface side;

a moving mechanism including a moving unit movable so as to move the pressing member in a direction for pressing the belt and a direction opposite to the direction for pressing the belt;

an attachable unit including at least one of the pressing member or the belt and configured to be attached to and detached from the image forming apparatus;

a control unit configured to execute a mode for transferring the toner image from the belt onto the recording material by pressing the belt using the pressing member; and a storage unit configured to store information that is based on an individual difference of the attachable unit that is related to a setting of a position of the moving unit, wherein the control unit sets the position of the moving unit in executing the mode for transferring the toner image based on the information stored in the storage unit.

2. The image forming apparatus according to claim 1, wherein the stored information includes at least one of the following: information regarding urging force of the pressing member or information regarding tensional force of the belt.

3. The image forming apparatus according to claim 1, wherein the stored information includes information from at least one of the following: (i) a material characteristic or a dimension of the pressing member, (ii) a position of the pressing member in a case where the moving unit is at a predetermined position, (iii) the position of the moving unit in a case where predetermined urging force of the pressing member is obtained, (iv) a relationship between the position of the pressing member and a moving amount of the moving unit, (v) a material characteristic or a dimension of the belt, (vi) a material characteristic, a position, or a dimension of at least one tension roller of the plurality of tension rollers, or (vii) urging force of a tensional force adding unit configured to add a tensional force to the belt.

4. The image forming apparatus according to claim 1, wherein the stored information includes information regarding the position of the moving unit in executing the mode for transferring the toner image that is set based on at least one of the following: information regarding urging force of the pressing member or information regarding tensional force of the belt.

5. The image forming apparatus according to claim 1, further comprising an input unit configured to input the information into the storage unit to be stored.

6. The image forming apparatus according to claim 1, further comprising an information-added portion to which the stored information is added, wherein the information-added portion is included in the attachable unit.

7. The image forming apparatus according to claim 6, further comprising an input unit configured to input the information into the storage unit to be stored, wherein the information-added portion includes a described portion in which the stored information is described, and wherein the input unit includes an operation unit configured to receive, from an operator, input of information described in the described portion.

8. The image forming apparatus according to claim 1, wherein the moving unit is pivotable about a pivotal axis line substantially parallel to a width direction of the belt, and the control unit is configured to set a position in a pivotal direction of the moving unit in executing the mode for transferring the toner image.

9. The image forming apparatus according to claim 8, wherein the moving mechanism includes a motor configured to cause the moving unit to pivot, and the control unit is configured to control the position in the pivotal direction of the moving unit by controlling a drive amount of the motor.

10. The image forming apparatus according to claim 1, wherein the pressing member is arranged in such a manner that a longitudinal direction of pressing member is substantially parallel to a width direction of the belt, and is connected to the moving unit at an end of the moving unit in a transverse direction on an upstream side in the rotational direction of the belt, and wherein the end of the moving unit in the transverse direction on a downstream side in the rotational direction of the belt is formed by a plate-like member contactable to the inner circumferential surface of the belt.

11. The image forming apparatus according to claim 1, wherein the attachable unit is a first attachable unit and, in a case where the first attachable unit is replaced with a second attachable unit, the control unit performs processing of updating the information regarding the first attachable unit stored in the storage unit with information corresponding to the second attachable unit.

12. The image forming apparatus according to claim 11, further comprising a display unit configured to display an input screen configured to receive information input by an operator and based on the individual difference of the second attachable unit that is related to the setting of the position of the moving unit in executing the mode for transferring the toner image.

13. A transfer unit attachable to and detachable from an image forming apparatus, the transfer unit comprising:

a belt that is rotatable and endless, and configured to bear a toner image;

a plurality of tension rollers including an inner roller and an upstream roller arranged adjacently to the inner roller at an upstream of the inner roller in a rotational direction of the belt, wherein the plurality of tension rollers is configured to stretch the belt around the inner roller and the upstream roller;

an outer member arranged to face the inner roller via the belt and configured to form a transfer portion at which the toner image is transferred from the belt in cooperation with the inner roller onto a recording material;

a pressing member configured to contact an inner circumferential surface of the belt at the upstream of the inner roller and a downstream of the upstream roller in the rotational direction of the belt, and press the inner circumferential surface of the belt toward an outer circumferential surface side;

a moving mechanism including a moving unit movable so as to move the pressing member in a direction for pressing the belt and a direction opposite to the direction for pressing the belt; and a described portion in which information is described that is based on an individual difference of the transfer unit that is related to a setting of a position of the moving unit in executing a mode for transferring the toner image from the belt onto the recording material by pressing the belt using the pressing member.

14. The transfer unit according to claim 13, wherein the described information includes at least one of the following: information regarding urging force of the pressing member or information regarding tensional force of the belt.

15. The transfer unit according to claim 13, wherein the described information includes information from at least one of the following: (i) a material characteristic or a dimension of the pressing member, (ii) a position of the pressing member in a case where the moving unit is at a predetermined position, (iii) the position of the moving unit in a case where predetermined urging force of the pressing member is obtained, (iv) a relationship between the position of the pressing member and a moving amount of the moving unit, (v) a material characteristic or a dimension of the belt, (vi) a material characteristic, a position, or a dimension of at least one tension roller of the plurality of tension rollers, or (vii) urging force of a tensional force adding unit configured to add a tensional force to the belt.

16. The transfer unit according to claim 13, wherein the described information includes information regarding the position of the moving unit in executing the mode for transferring the toner image that is set based on at least one of the following: information regarding urging force of the pressing member or information regarding tensional force of the belt.

17. The transfer unit according to claim 13, wherein the moving unit is pivotable about a pivotal axis line substantially parallel to a width direction of the belt, and the image forming apparatus is configured to set a position in a pivotal direction of the moving unit in executing the mode for transferring the toner image.

18. The image forming apparatus according to claim 17, wherein the moving mechanism includes a motor configured to cause the moving unit to pivot, and the image forming apparatus is configured to control the position in the pivotal direction of the moving unit by controlling a drive amount of the motor.

19. The transfer unit according to claim 13, wherein the pressing member is arranged in such a manner that a longitudinal direction of pressing member is substantially parallel to a width direction of the belt, and is connected to the moving unit at an end of the moving unit in a transverse direction on an upstream side in the rotational direction of the belt, and wherein the end of the moving unit in the transverse direction on a downstream side in the rotational direction of the belt is formed by a plate-like member contactable to the inner circumferential surface of the belt.

* * * * *